US012727646B2

(12) United States Patent
Sussmann et al.

(10) Patent No.: US 12,727,646 B2
(45) Date of Patent: Sep. 8, 2026

(54) ARTICLE OF FOOTWEAR HAVING REMOVABLE COMPONENTS

(71) Applicant: PUMA SE, Herzogenaurach (DE)

(72) Inventors: Reinhold Sussmann, Scheinfeld (DE); Martin Weber, Nuremberg (DE)

(73) Assignee: PUMA SE, Herzogenaurach (DE)

( * ) Notice: Subject to any disclaimer, the term of this patent is extended or adjusted under 35 U.S.C. 154(b) by 66 days.

(21) Appl. No.: 17/991,961

(22) Filed: Nov. 22, 2022

(65) Prior Publication Data

US 2023/0157412 A1 May 25, 2023

Related U.S. Application Data

(60) Provisional application No. 63/282,018, filed on Nov. 22, 2021.

(51) Int. Cl.
*A43B 3/24* (2006.01)
*A43B 13/12* (2006.01)
*A43B 13/36* (2006.01)

(52) U.S. Cl.
CPC ..... *A43B 13/36* (2013.01); *A43B 3/246* (2013.01); *A43B 13/125* (2013.01)

(58) Field of Classification Search
CPC ..... A43B 3/0047; A43B 3/24; A43B 3/244; A43B 3/246; A43B 13/36
See application file for complete search history.

(56) References Cited

U.S. PATENT DOCUMENTS 1,219,881 A 3/1917 Sundback
3,019,534 A * 2/1962 Kauffman ..... A43B 3/246 D2/977
4,317,294 A * 3/1982 Goodyear ..... A43B 13/36 36/36 B
4,377,042 A * 3/1983 Bauer ..... A43B 13/36 36/15
4,936,028 A 6/1990 Posacki
5,317,822 A * 6/1994 Johnson ..... A43B 13/36 36/15
7,565,754 B1 7/2009 Acheson et al.
8,991,071 B2 * 3/2015 Bathum ..... A43B 1/0027 36/11.5
10,104,936 B2 * 10/2018 Mulholland ..... A43B 5/1641
2005/0268494 A1 * 12/2005 Halliday ..... A43B 13/181 36/15

(Continued)

FOREIGN PATENT DOCUMENTS

CN 202890698 U * 4/2013
DE 29715533 U1 1/1998
WO WO-2015024534 A1 * 2/2015 ..... A43B 13/36

OTHER PUBLICATIONS

Partial European Search Report dated Mar. 27, 2023 from European Patent Application No. 22208122.5 (13 pages).

*Primary Examiner* — Sharon M Prange
(74) *Attorney, Agent, or Firm* — Quarles & Brady LLP

(57) ABSTRACT

An article of footwear having an interlocking assembly that includes a first component and a second component. The first component has a plurality of ribs and the second component has a plurality of receptacles. The plurality of ribs of the first component are configured to be received within the plurality of receptacles of the second component to removably attach the first component and the second component.

16 Claims, 10 Drawing Sheets

(56) References Cited

U.S. PATENT DOCUMENTS

| | | | | |
|---|---|---|---|---|
| 2006/0021260 | A1* | 2/2006 | Kim | A43B 21/39 36/130 |
| 2006/0277792 | A1 | 12/2006 | Schoenborn | |
| 2008/0222920 | A1* | 9/2008 | Rovida | A43B 3/0047 36/62 |
| 2014/0259778 | A1* | 9/2014 | Anderson | A43B 3/242 36/100 |
| 2017/0027282 | A1* | 2/2017 | Santos | A43B 13/36 |
| 2017/0127758 | A1* | 5/2017 | Cooper | A43B 7/1405 |
| 2021/0100319 | A1* | 4/2021 | Kelleher | A43B 5/02 |
| 2022/0071338 | A1* | 3/2022 | Lyden | A43B 17/18 |
| 2023/0320460 | A1* | 10/2023 | Jover Todoli | A43B 3/246 36/103 |

* cited by examiner

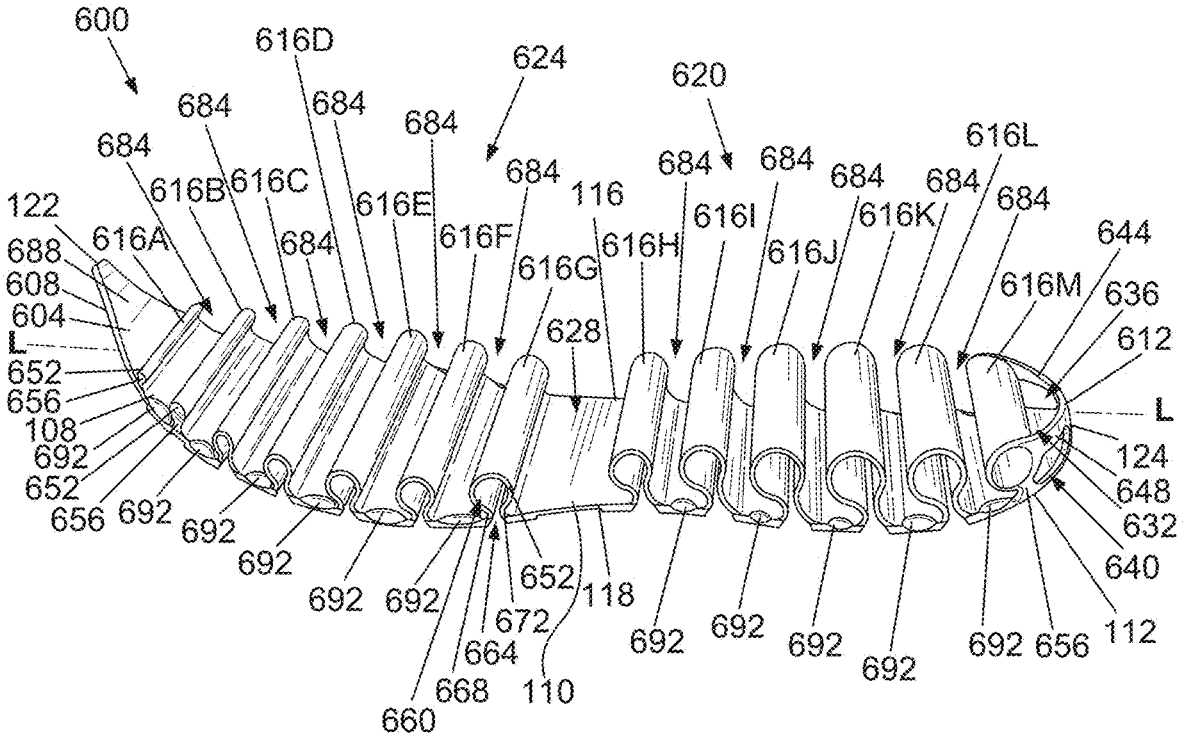
600
616D
624
620
684
684
684
684
684
684
684
684
684
684
684
684
616L
616B
616C
616E
616F
616G
616H
616I
616J
616K
616M
116
122
616A
688
608
604
L
652
656
108
692
652
656
692
692
692

ARTICLE OF FOOTWEAR HAVING REMOVABLE COMPONENTS

CROSS REFERENCE TO RELATED APPLICATIONS

This application claims the benefit of and priority to U.S. Provisional App. No. 63/282,018, filed on Nov. 22, 2021, which is herein incorporated by reference in its entirety.

REFERENCE REGARDING FEDERALLY SPONSORED RESEARCH OR DEVELOPMENT

Not applicable

SEQUENCE LISTING

Not applicable

BACKGROUND

1. Field of the Invention

The present disclosure relates generally to an article of footwear including a removable outsole.

2. Description of the Background

Many conventional shoes or other articles of footwear generally comprise an upper and a sole attached to a lower end of the upper. Conventional shoes further include an internal space, i.e., a void or cavity, which is created by interior surfaces of the upper and sole, that receives a foot of a user before securing the shoe to the foot. The sole is attached to a lower surface or boundary of the upper and is positioned between the upper and the ground. As a result, the sole typically provides stability and cushioning to the user when the shoe is being worn. In some instances, the sole may include multiple components, such as an outsole, a midsole, and an insole. The outsole may provide traction to a bottom surface of the sole, and the midsole may be attached to an inner surface of the outsole, and may provide cushioning or added stability to the sole. For example, a sole may include a particular foam material that may increase stability at one or more desired locations along the sole, or a foam material that may reduce stress or impact energy on the foot or leg when a user is running, walking, or engaged in another activity. The sole may also include additional components, such as plates, embedded with the sole to increase the overall stiffness of the sole and reduce energy loss during use. Further, the components of the sole are often permanently attached to each other using a joining process that involves an adhesive and/or compound, which requires substantial energy inputs and labor. In addition, the adhesive and/or compounds can limit the potential for recycling the shoe.

The upper generally extends upward from the sole and defines an interior cavity that completely or partially encases a foot. In most cases, the upper extends over the instep and toe regions of the foot, and across medial and lateral sides thereof. Many articles of footwear may also include a tongue that extends across the instep region to bridge a gap between edges of medial and lateral sides of the upper, which define an opening into the cavity. The tongue may also be disposed below a lacing system and between medial and lateral sides of the upper, to allow for adjustment of shoe tightness. The tongue may further be manipulable by a user to permit entry or exit of a foot from the internal space or cavity. In addition, the lacing system may allow a user to adjust certain dimensions of the upper or the sole, thereby allowing the upper to accommodate a wide variety of foot types having varying sizes and shapes.

The upper of many shoes may comprise a wide variety of materials, which may be utilized to form the upper and chosen for use based on one or more intended uses of the shoe. The upper may also include portions comprising varying materials specific to a particular area of the upper. For example, added stability may be desirable at a front of the upper or adjacent a heel region so as to provide a higher degree of resistance or rigidity. In contrast, other portions of a shoe may include a soft woven textile to provide an area with stretch-resistance, flexibility, air-permeability, or moisture-wicking properties.

However, in many cases, articles of footwear having sole structures with an increased comfort and better fit are desired, along with soles having improved cushioning systems or structural characteristics. In addition, articles of footwear are desired that are manufactured according to more efficient manufacturing methods and more easily recycled.

SUMMARY

An article of footwear, as described herein, may have various configurations. The article of footwear may have an upper and a sole structure connected to the upper.

In one aspect, an interlocking assembly for an article of footwear includes a first component having a plurality of ribs and a second component having a plurality of receptacles. The plurality of ribs of the first component are configured to be received within the plurality of receptacles of the second component to removably attach the first component and the second component. In some embodiments, at least one of the plurality of receptacles is exposed through a lower surface of the second component. In some embodiments, the plurality of receptacles is located between the lower surface and a top surface of the second component. In some embodiments, the plurality of receptacles is located between a medial side and a lateral side of the second component. In some embodiments, the plurality of ribs extends from a heel region to a midfoot region of the first component. In some embodiments, the first component is formed of a different material than the second component. In some embodiments, the first component is configured to snap into the second component.

In another aspect, a sole structure for an article of footwear includes a midsole and an outsole. The outsole includes a plurality of ribs that are configured to be received within a portion of the midsole. In some embodiments, the plurality of ribs are disposed within a heel region the plurality of ribs are exposed through a lateral side and a medial side of the midsole. In some embodiments, one or more of the plurality of ribs includes a cavity. In some embodiments, one or more of the plurality of ribs extends from a lateral side to a medial side of the midsole. In some embodiments, each rib of the plurality of ribs is configured to removably retain the outsole against the midsole.

In still another aspect, an interlocking assembly for an article of footwear includes a midsole having a flange that includes a securing feature and an outsole having a chamber that is at least partially defined by a clip extending from a heel end of the outsole. The flange is configured to be received within the chamber in an assembled configuration. In addition, the securing feature is configured to be removably engaged with the clip in the assembled configuration. In some embodiments, a through hole is at least partially defined by the clip and configured to receive the securing feature in the assembled configuration. In some embodiments, the securing feature includes a first block extending from a lateral side of the flange and a second block extending from a medial side of the flange. In some embodiments, the clip extends from a top surface of the outsole and between a medial side and a lateral side of a rib to at least partially define the chamber. In some embodiments, the rib includes a rounded head extending from a curved base, a cavity extending through the head, and a slot extending through the base. Additionally, the flange at least partially defines a receptacle of the midsole and the head of the rib is configured to fit within the receptacle of the midsole in the assembled configuration. In some embodiments, the outsole and the midsole are configured to be flexed away from one another during disassembly of the interlocking assembly.

Other aspects of the article of footwear, including features and advantages thereof, will become apparent to one of ordinary skill in the art upon examination of the figures and detailed description herein. Therefore, all such aspects of the article of footwear are intended to be included in the detailed description and this summary.

BRIEF DESCRIPTION OF THE DRAWINGS

FIG. 11 is a schematic representation of a top perspective view of another embodiment of an outsole;

FIG. 12 is a schematic representation of a bottom perspective view of the outsole of FIG. 11;

DETAILED DESCRIPTION OF THE DRAWINGS

Figure 1:
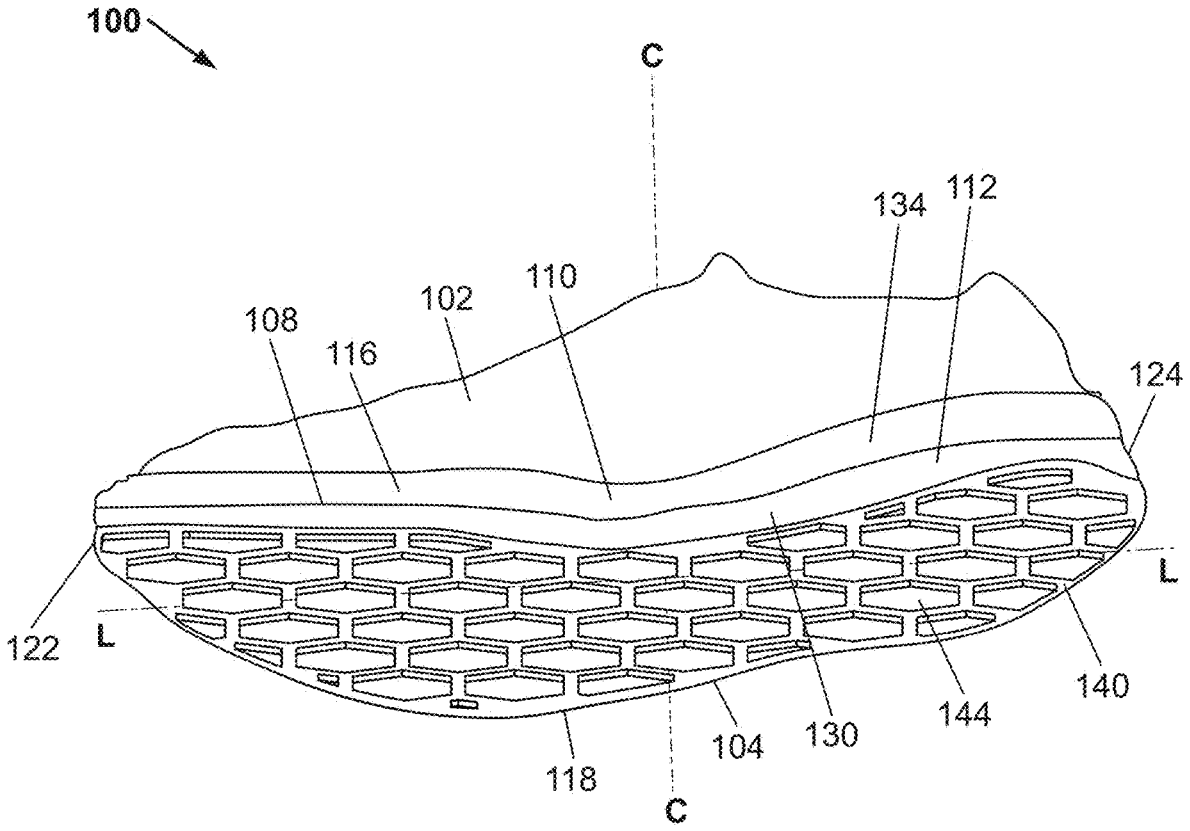
FIG. 1 is a perspective view of a bottom and medial side of an article of footwear configured as a right shoe that includes an upper and a sole structure, according to an embodiment of the disclosure.

The following discussion and accompanying figures disclose various embodiments or configurations of a shoe and a sole structure. Although embodiments of a shoe or sole structure are disclosed with reference to a sports shoe, such as a running shoe, tennis shoe, basketball shoe, etc., concepts associated with embodiments of the shoe or the sole structure may be applied to a wide range of footwear and footwear styles, including cross-training shoes, football shoes, golf shoes, hiking shoes, hiking boots, ski and snowboard boots, soccer shoes and cleats, walking shoes, and track cleats, for example. Concepts of the shoe or the sole structure may also be applied to articles of footwear that are considered non-athletic, including dress shoes, sandals, loafers, slippers, and heels. In addition to footwear, particular concepts described herein may also be applied and incorporated in other types of apparel or other athletic equipment, including helmets, padding or protective pads, shin guards, and gloves. Even further, particular concepts described herein may be incorporated in cushions, backpack straps, golf clubs, or other consumer or industrial products. Accordingly, concepts described herein may be utilized in a variety of products.

The term "about," as used herein, refers to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values ±5% of the numeric value that the term precedes.

The present disclosure is directed to an article of footwear and/or specific components of the article of footwear, such as an upper and/or a sole or sole structure. The upper may comprise a knitted component, a woven textile, and/or a non-woven textile. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, and/or other suitable knitting operations. The knit textile may have a plain knit structure, a mesh knit structure, and/or a rib knit structure, for example. Woven textiles include, but are not limited to, textiles formed by way of any of the numerous weave forms, such as plain weave, twill weave, satin weave, dobbin weave, jacquard weave, double weaves, and/or double cloth weaves, for example. Non-woven textiles include textiles made by air-laid and/or spun-laid methods, for example. The upper may comprise a variety of materials, such as a first yarn, a second yarn, and/or a third yarn, which may have varying properties or varying visual characteristics.

FIG. 1 depicts an exemplary embodiment of an article of footwear 100 including an upper 102 and a sole structure 104. The upper 102 is attached to the sole structure 104 and together define an interior cavity (not shown) into which a foot may be inserted. For reference, the article of footwear 100 defines a forefoot region 108, a midfoot region 110, and a heel region 112. The forefoot region 108 generally corresponds with portions of the article of footwear 100 that encase portions of the foot that includes the toes, the ball of the foot, and joints connecting the metatarsals with the toes or phalanges. The midfoot region 110 is proximate and adjoining the forefoot region 108, and generally corresponds with portions of the article of footwear 100 that encase the arch of foot, along with the bridge of the foot. The heel region 112 is proximate and adjoining the midfoot region 110 and generally corresponds with portions of the article of footwear 100 that encase rear portions of the foot, including the heel or calcaneus bone, the ankle, and/or the Achilles tendon.

Many conventional footwear uppers are formed from multiple elements (e.g., textiles, polymer foam, polymer sheets, leather, and synthetic leather) that are joined through bonding or stitching at a seam. In some embodiments, the upper 102 of the article of footwear 100 is formed from a knitted structure or knitted components. In various embodiments, a knitted component may incorporate various types of yarn that may provide different properties to an upper. For example, one area of the upper 102 may be formed from a first type of yarn that imparts a first set of properties, and another area of the upper 102 may be formed from a second type of yarn that imparts a second set of properties. Using this configuration, properties of the upper 102 may vary throughout the upper 102 by selecting specific yarns for different areas of the upper 102.

The article of footwear 100 also includes a medial side 116 and a lateral side 118. In particular, the lateral side 118 corresponds to an outside portion of the article of footwear 100 and the medial side 116 corresponds to an inside portion of the article of footwear 100. As such, left and right articles of footwear have opposing lateral and medial sides, such that the medial sides 116 are closest to one another when a user is wearing the articles of footwear 100, while the lateral sides 118 are defined as the sides that are farthest from one another while being worn. The medial side 116 and the lateral side 118 adjoin one another at opposing, distal ends of the article of footwear 100, although other configurations are possible.

The article of footwear 100 further includes a toe end 122 and a heel end 124. In particular, the toe end 122 corresponds to a front-most portion of the article of footwear 100 and the heel end 124 corresponds to a rear-most portion of the article of footwear 100. As such, the toe end 122 and the heel end 124 are disposed at opposing ends of the article of footwear 100. In some embodiments, the toe end 122 is disposed within the forefoot region 108 and the heel end 124 is disposed within the heel region 112, although other configurations are possible.

Unless otherwise specified, the forefoot region 108, the midfoot region 110, the heel region 112, the medial side 116, and the lateral side 118 are intended to define boundaries or areas of the article of footwear 100. To that end, the forefoot region 108, the midfoot region 110, the heel region 112, the medial side 116, and the lateral side 118 generally characterize sections of the article of footwear 100. Further, both the upper 102 and the sole structure 104 may be characterized as having portions within the forefoot region 108, the midfoot region 110, the heel region 112, and on the medial side 116 and the lateral side 118. Therefore, the upper 102 and the sole structure 104, and/or individual portions of the upper 102 and the sole structure 104, may include portions thereof that are disposed within the forefoot region 108, the midfoot region 110, the heel region 112, and on the medial side 116 and the lateral side 118.

The sole structure 104 is connected or secured to the upper 102 and extends between a foot of a user and the ground when the article of footwear 100 is worn by the user. The sole structure 104 may include one or more components, which may include an outsole, a midsole, a heel, a vamp, and/or an insole. For example, in some embodiments, a sole structure may include an outsole that provides structural integrity to the sole structure, along with providing traction for a user, a midsole that provides a cushioning system, and an insole that provides support for an arch of a user. As will be further discussed herein, the sole structure 104 of the present embodiment of the invention includes one or more components that provide the sole structure 104 constructed with a removable outsole.

In the illustrated embodiment, the sole structure 104 includes an outsole 130 and a midsole 134. The outsole 130 may define a bottom end or bottom surface 140 of the sole structure 104 across the heel region 112, the midfoot region 110, and the forefoot region 108. Further, the outsole 130 may include a ground-engaging portion or include a ground-engaging surface of the sole structure 104 and may be opposite of the insole thereof. As illustrated in FIG. 1, the bottom surface 140 of the outsole may include a tread pattern 144 that can include a variety of shapes and configurations. The outsole 130 may be formed from one or more materials to impart durability, wear-resistance, abrasion resistance, or traction to the sole structure 104. In some embodiments, the outsole 130 may be formed from any kind of elastomer material, e.g., rubber, including thermoset elastomers or thermoplastic elastomers, or a thermoplastic material, e.g., thermoplastic polyurethane (TPU). In some embodiments, the outsole 130 may define a shore A hardness up to 95. In addition, the outsole 130 may be manufactured by a process involving injection molding, vulcanization, printing layer by layer, i.e., additive manufacturing systems or methods, and the like.

Still referring to FIG. 1, the midsole 134 may be individually constructed from a thermoplastic material, such as polyurethane (PU), for example, and/or an ethylene-vinyl acetate (EVA), copolymers thereof, or a similar type of material. In other embodiments, the midsole 134 may be an EVA-Solid-Sponge ("ESS") material, an EVA foam (e.g., PUMA® ProFoam Lite™ IGNITE Foam), polyurethane, polyether, an olefin block copolymer, organosheets, a thermoplastic material (e.g., a thermoplastic polyurethane, a thermoplastic elastomer, a thermoplastic polyolefin, etc.), or a supercritical foam. The midsole 134 may be a single polymeric material or may be a blend of materials, such as an EVA copolymer, a thermoplastic polyurethane, a polyether block amide (PEBA) copolymer, and/or an olefin block copolymer. One example of a PEBA material is PEBAX®. In some embodiments, the midsole 134 is manufactured by a process involving injection molding, vulcanization, printing layer by layer, i.e., additive manufacturing systems or methods, and the like.

In embodiments where the midsole 134 is formed from a supercritical foaming process, the supercritical foam may comprise micropore foams or particle foams, such as a TPU, EVA, PEBAX®, or mixtures thereof, manufactured using a process that is performed within an autoclave, an injection molding apparatus, or any sufficiently heated/pressurized container that can process the mixing of a supercritical fluid (e.g., $CO_2$, $N_2$, or mixtures thereof) with a material (e.g., TPU, EVA, polyolefin elastomer, or mixtures thereof) that is preferably molten. During an exemplary process, a solution of supercritical fluid and molten material is pumped into a pressurized container, after which the pressure within the container is released, such that the molecules of the supercritical fluid rapidly convert to gas to form small pockets within the material and cause the material to expand into a foam. In further embodiments, the midsole 134 may be formed using alternative methods known in the art, including the use of an expansion press, an injection machine, a pellet expansion process, a cold foaming process, a compression molding technique, die cutting, or any combination thereof. For example, the midsole 134 may be formed using a process that involves an initial foaming step in which supercritical gas is used to foam a material and then compression molded or die cut to a particular shape.

In the illustrated embodiment of FIG. 1, the sole structure 104 is provided as an interlocking assembly in which a first component, such as the outsole 130, and a second component, such as the midsole 134, are removably coupled to one another by mechanical attachment features, as will be described in more detail throughout this disclosure. With reference to FIG. 1, a central axis C extends vertically through the article of footwear 100 within the midfoot region 110 and a longitudinal axis L extends horizontally, i.e., perpendicular to the central axis C, along the outsole 130 and intersects the toe end 122 and the heel end 124 of the article of footwear 100. To that end, at least a portion of the bottom surface 140 of the outsole 130 is tangent or otherwise coincident with a longitudinal plane defined by the longitudinal axis L. In some embodiments, the outsole 130 and the midsole 134 are each curved or bowed in a vertical direction parallel with the central axis C and, as a result, the outsole 130 may define concave or convex curvatures relative to the longitudinal plane of the longitudinal axis L.

Figure 2:
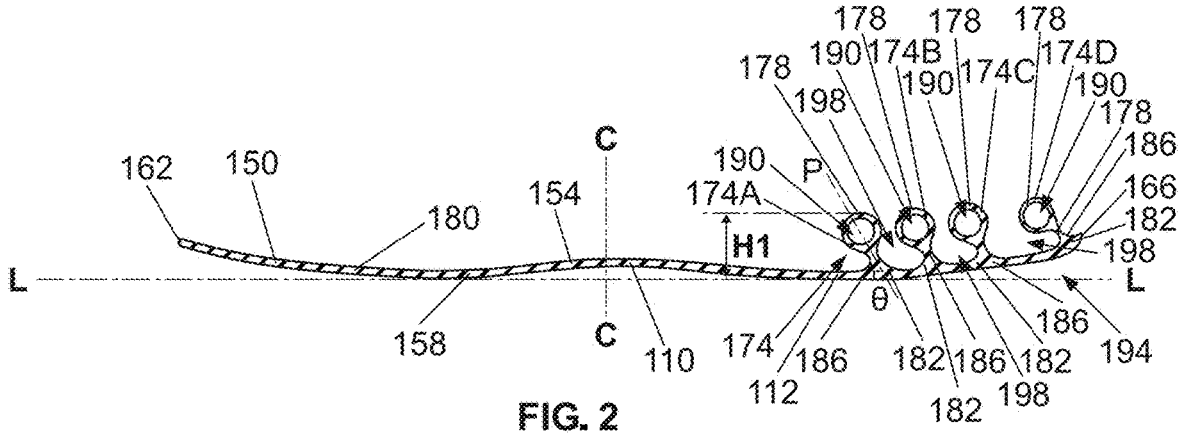
FIG. 2 is a schematic representation of a cross-sectional view of an outsole.

FIG. 2 illustrates a schematic representation of a cross-sectional view of an embodiment of an outsole 150 that includes a top surface 154 that is opposite a bottom surface 158 and extends between a toe end 162 and a heel end 166. Further, the outsole 150 includes attachment features in the form of ribs 174. In particular, each of the ribs 174 includes a head 178 that is connected to a base 182 by a stem 186. The base 182 is positioned on the top surface 154 of the outsole 150 and defines an interface between each rib 174 and the top surface 154 of the outsole 150. As illustrated in FIG. 2, the ribs 174 are provided as a plurality including ribs 174A, 174B, 174C, and 174D, labeled in sequential order moving in a toe-to-heel direction, i.e., heel-ward. Accordingly, the ribs 174 include the most toe-ward rib 174A, i.e., spaced farthest from heel end 166 of the outsole 150, and the most heel-ward rib 174D, i.e., located closest to the heel end 166 of the outsole 150, and the ribs 174B and 174C are located therebetween. In some embodiments, greater or fewer ribs 174 are provided. For purposes of clarity, it will be appreciated that the ribs 174A-D may be referred to herein individually or collectively as rib(s) 174.

In the illustrated embodiment, the base 182 of each rib 174 narrows from the top surface 154 to the stem 186 of each rib 174, such that the base 182 is wider, i.e., dimension in a horizontal direction, than the stem 186 and, in particular, the base 182 curves between the top surface 154 and the stem 186. In this way, the base 182 provides stability for each rib 174, which allows for bending of each rib 174 about each base 182 in toe-ward or heel-ward directions.

With continued reference to FIG. 2, the head 178 is connected to the stem 186 opposite the base 182. In some embodiments, the head 178 extends outwardly from the stem 186 in both vertical and horizontal directions. In some embodiments, the head 178 is wider and taller, i.e., dimension H1 measured in the vertical direction between the head 178 and the bottom surface 158, than the stem 186. In the illustrated embodiment, the head 178 is provided as having a generally rounded or circular cross-sectional shape, although the head 178 may be sized and shaped differently. For example, the head 178 may define a rectangular, triangular, elliptical, trapezoidal, conical, frustoconical, pyramidal, frustopyramidal, alphabetical, numerical, pictogram, logogram, ideogram, or any irregular cross-sectional shape, among others.

Further, the stem 186 extends away from the head 178 to define a projection axis P. For purposes of clarity, the projection axis P is illustrated only for the rib 174A; however, it will be understood that each rib 174 includes a projection axis P defined along the stem 186. As depicted in FIG. 2, the projection axis P forms an angle θ relative to the longitudinal axis L, such that the rib 174A extends at the angle θ relative to the longitudinal axis L. In some embodiments, the ribs 174 are disposed orthogonally with respect to the longitudinal axis L. In the illustrated embodiment, the rib 174A extends at an angle θ that is less than 90 degrees, although other configurations are possible. For example, two or more of the ribs 174 can extend parallel with each other at an angle θ that is greater than 90 degrees. Alternatively, two or more of the ribs 174 can extend at varying angles θ.

Still referring to FIG. 2, the projection axis P extends through a center of the head 178 of the rib 174, such that the head 178 is generally centered on the projection axis P and, thus, the head 178 is generally centered on the stem 186. In some embodiments, the head 178 is offset relative to the stem 186 and the projection axis P. For example, the head 178 may extend substantially toe-ward of the stem 186, such that the head 178 is substantially disposed toe-ward of the projection axis P. Alternatively, the head 178 can extend substantially heel-ward of the stem 186, such that the head 178 is substantially disposed heel-ward of the projection axis P. The location of the head 178 relative to the stem 186 impacts cushioning and/or stiffness performance properties of the rib 174 and/or the outsole 150.

With continued reference to FIG. 2, each rib 174 is partially hollow in that the head 178 includes a cavity 190 extending partially or entirely through the head 178 in a lateral-to-medial direction. In some embodiments, the cavity 190 is empty, although other configurations are possible. It is contemplated that the cavity 190 may be partially or entirely filled with a fluid, gas, liquid, bead-like particles, foams, bio-degradeable materials, bacteria, spring members, or dampening members, among others. In some embodiments, the cavity 190 is open and exposed on the lateral side 118 or the medial side 116 of the footwear 100. The cavity 190 may be interrupted or, instead, the cavity 190 may extend continuously through the entire extent of the head 178. In some examples, the cavity 190 may extend into or communicate with the stem 186, the base 182, and the bottom surface 158 of the outsole 150. For example, the cavity 190 may extend from the head 178 through the stem 186 to be exposed at the bottom surface 158 of the outsole 150. In this way, the cavity 190 can perform several functions including, e.g., a sound chamber, an air vent or pathway, a negative space that reduces weight and/or density, and an aesthetic features, among others.

As illustrated in FIG. 2, the ribs 174 are located in the heel region 112 of the footwear 100 and define an outsole attachment region 194 of the outsole 150. The outsole attachment region 194 forms a boundary or periphery that surrounds the ribs 174 and, thus, the outsole attachment region 194 defines an area or surface area. In some embodiments, the outsole attachment region 194 comprises less than 50% of a total surface area of the top surface 154 of the outsole 150. It is contemplated that the outsole attachment region 194 comprises greater than 50% of the total area of the top surface 154. In addition, the ribs 174 can be located in the forefoot region 108 and the midfoot region 110, such that the outsole attachment region 194 is located within the forefoot region 108 and the midfoot region 110. It is further contemplated that multiple outsole attachment regions may be defined by discrete sets or groupings of ribs, as will be described below.

Staying with FIG. 2, the ribs 174 are spaced apart from one another to form gaps 198 between the ribs 174 and across the top surface 154 of the outsole 150. The gaps 198 are sized and shaped in accordance with the ribs 174, such that the gaps 198 can be enlarged or minimized by changing a size or shape of the ribs 174 or by changing a spacing, i.e., a distance, between each of the ribs 174. The ribs 174 are spaced apart varying distances, such as the relatively larger distance between the rib 174C and the rib 174D. Further, the ribs 174 of the present embodiment are depicted in cross-sectional view but it shall be appreciated that the ribs 174 extend at least partially between the lateral side 118 and the medial side 116 of footwear 100 (see FIG. 1). In some embodiments, the ribs 174 extend continuously between the lateral side 118 and the medial side 116 of the footwear 100, although other configurations are possible. It is contemplated that one or more of the ribs 174 is provided as a set or array of discrete portions that may be identical to one another or differently shaped from one another and that are spaced apart from one another in a lateral-to-medial or medial-to-lateral direction. It is further contemplated that one or more of the ribs 174 are provided as varying dimensionally in a vertical or horizontal direction between the lateral side 118 and the medial side 116 of the footwear 100. Further, it is contemplated that the ribs 174 may be provided as curved concavely or convexly relative to the central plane of the central axis C.

With continued reference to FIG. 2, the outsole 150 is curved or bowed relative to the longitudinal plane of the longitudinal axis L. In the illustrated embodiment, the outsole 150 curves away from the longitudinal plane at the toe end 162 and the heel end 166 and also within the midfoot region 110. To that end, the outsole 150 is convexly curved in the forefoot region 108 and the heel region 112 and concavely curved in the midfoot region 110. It is contemplated that the outsole 150 is concavely or convexly curved in other directions, such as between the lateral side 118 and the medial side 116 (see FIG. 1).

Figure 3:
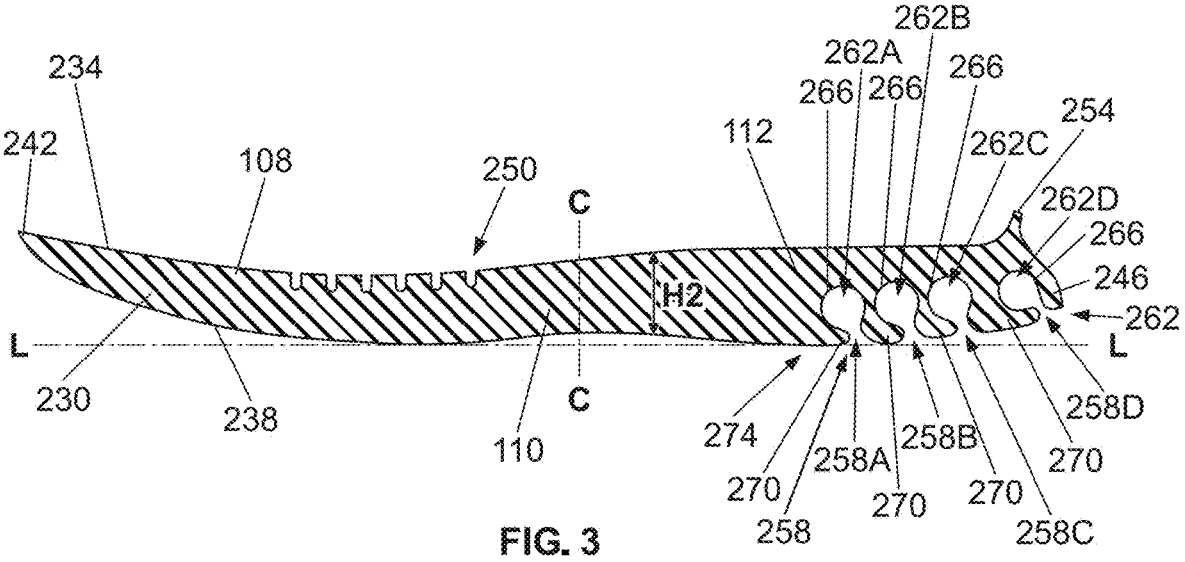
FIG. 3 is a schematic representation of a cross-sectional view of a midsole.

FIG. 3 illustrates a schematic, sectional view of a midsole 230 that includes an upper surface 234 opposite a lower surface 238 and extends between a toe end 242 and a heel end 246. In the illustrated embodiment, a plurality of ridges 250 are formed in the upper surface 234 within the forefoot region 108 and a rim 254 extends from the upper surface 234 within the heel region 112 proximate to the heel end 246. The midsole 230 varies in height H2 between the toe end 242 and the heel end 246, such that the midsole 230 is shorter within the forefoot region 108 than within the heel region 112, although other configurations are possible.

As illustrated in FIG. 3, apertures 258 are formed in the lower surface 238 of the midsole 230. In the illustrated embodiment, the apertures 258 communicate with respective receptacles 262 that are formed internally within the midsole 230 between the lower surface 238 and the upper surface 234. Each receptacle 262 is defined by an interior surface 266 of the midsole 230 to form a generally rounded or circular cross-sectional shape, such that the receptacles 262 are configured to receive the ribs 174 in an assembled configuration (see FIG. 4). Accordingly, the receptacles 262 are provided as any size and shape to correspond to the ribs 174. In the illustrated embodiment of FIG. 3, the receptacles 262 are a plurality including receptacles 262A, 262B, 262C, 262D, labeled in sequential order moving in a toe-to-heel direction, i.e., heel-ward. Accordingly, the receptacles 262 include the most toe-ward receptacle 262A, i.e., spaced farthest from the heel end 246 of the midsole 230, and the most heel-ward receptacle 262D, i.e., located closest to the heel end 246 of the midsole 230, and the receptacles 262B and 262C are located therebetween. To that end, the apertures 258 are a plurality including apertures 258A that corresponds to the receptacle 262A, aperture 258B that corresponds to the receptacle 262B, aperture 258C that corresponds to the receptacle 262C, and aperture 258D that corresponds to the receptacle 262D. For purposes of clarity, it will be appreciated that the receptacles 262A-D may be referred to herein individually or collectively as receptacle(s) 262 and, also, that the apertures 258A-D may be referred to herein individually or collectively as aperture(s) 258.

Further, as illustrated in FIG. 3, the receptacles 262 are open and exposed through the lower surface 238 by the respective apertures 258, and the apertures 258 are relatively narrower than the receptacles 262. In particular, the apertures 258 are at least partially defined by flanges 270 of the midsole 230. The flanges 270 are provided in opposing pairs at the lower surface 238 of the midsole 230 to form the apertures 258 therebetween, such that a pair of flanges 270 extend inwardly toward each other without contacting one another. The flanges 270 vary in size and shape to resiliently engage with the ribs 174 of the outsole 150. Further, the flanges 270 are configured to fit within the gaps 198 of the outsole 150 when in an assembled configuration (see FIG. 4). Accordingly, the flanges 270 are generally L-shaped members, although other configurations are possible.

As illustrated in FIG. 3, the receptacles 262 are located in the heel region 112 of the footwear 100 and define a midsole attachment region 274 of the midsole 230 that is configured to correspond to the outsole attachment region 194 of the outsole 150. The midsole attachment region 274 forms a boundary or periphery that surrounds the receptacles 262 and, thus, the midsole attachment region 274 defines an area or surface area. In some embodiments, the midsole attachment region 274 comprises less than 50% of a total surface area of the lower surface 238 of the midsole 230. It is contemplated that the midsole attachment region 274 comprises greater than 50% of the total area of the lower surface 238. In addition, the receptacles 262 can be located in the forefoot region 108 and the midfoot region 110, such that the midsole attachment region 274 is located within the forefoot region 108 and the midfoot region 110. It is further contemplated that multiple midsole attachment regions may be defined by discrete sets or groupings of receptacles, as will be described below.

With continued reference to FIG. 3, the midsole 230 is curved or bowed relative to the longitudinal plane of the longitudinal axis L. In the illustrated embodiment, the midsole 230 curves away from the longitudinal plane at the toe end 242 and the heel end 246 and also within the midfoot region 110. To that end, the midsole 230 is convexly curved in the forefoot region 108 and the heel region 112 and concavely curved in the midfoot region 110. It is contemplated that the outsole 150 is concavely or convexly curved in other directions, such as between the lateral side 118 and the medial side 116 (see FIG. 1). In addition, the upper surface 234 of the midsole 230 follows a different curvature than the lower surface 238, such that the upper surface 234 is substantially more planar in the heel region than the lower surface 238, although other configurations are possible. Further, the midsole 230 and the outsole 150 are configured to be mated or fit with one another, such that the top surface 154 of the outsole 150 is curved and shaped to be in contact with the lower surface 238 of the midsole 230, as illustrated in FIG. 4.

Figure 4:
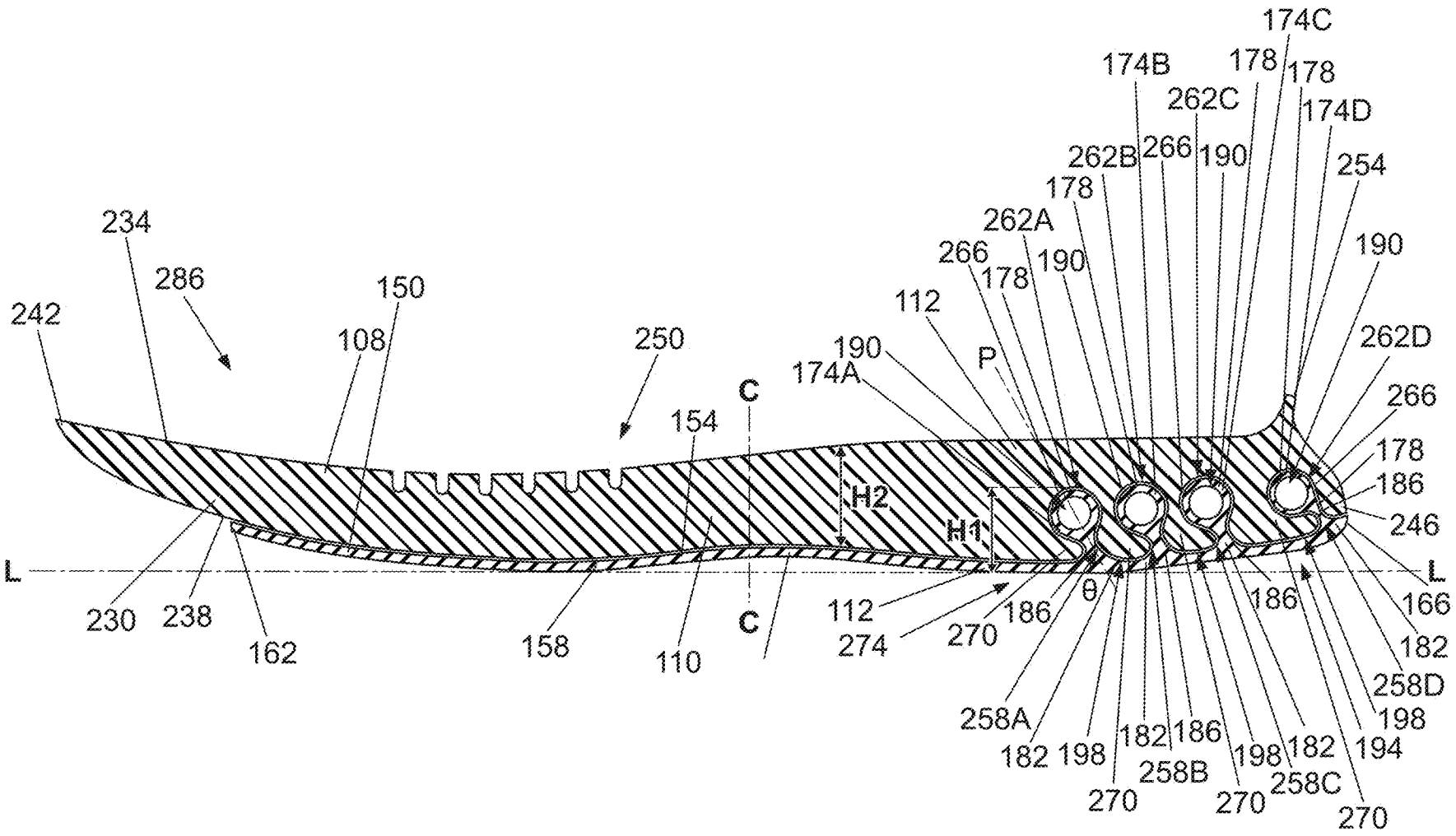
FIG. 4 is a schematic representation of a cross-sectional view of an interlocking assembly for a sole structure including the midsole of FIG. 3 and the outsole of FIG. 2, the interlocking assembly being depicted in an assembled configuration.

FIG. 4, schematic representation of the midsole 230 and the outsole 150 forming an interlocking assembly 286, which comprises at least part of sole structure 104 (see FIG. 1) for the article of footwear 100. In the illustrated embodiment of FIG. 4, the outsole 150 is partially received within the midsole 230 and, in particular, the ribs 174A-D of the outsole 150 are received within the receptacles 262A-D of the midsole 230 to secure the outsole 150 to the midsole 230. Further, the ribs 174A-D are configured to be removably coupled to the midsole 230 within the receptacles 262A-D, such that a user can selectively assemble and disassemble the interlocking assembly 286 by selectively coupling and decoupling the outsole 150 with the midsole 230. In this way, an interlocking function is performed by the ribs 174A-D of the outsole 150 interacting with the receptacles 262A-D of the midsole 230.

In FIG. 4, the ribs 174A-D are illustrated as being fully interlocked, i.e., fully assembled, with the receptacles 262A-D. To that end, an exemplary assembly process includes the head 178 of each rib 174 being received through the corresponding aperture 258 and within the corresponding receptacle 262. In particular, the head 178 of each rib 174 is aligned with the corresponding aperture 258 of the midsole 230 and then pushed or pressed against the flanges 270 of the lower surface 238 of the midsole 230 to pass the head 178 through the aperture 258 and toward the receptacle 262. Due to the enlarged size of the head 178 relative to the aperture 258, the head 178 is deformed, e.g., compressed, as it passes through the aperture 258. In some embodiments, the cavity 190 of each head 178 permits greater deformation, e.g., collapse, during assembly. Then, after the head 178 is pushed or pressed past the aperture 258 and into the receptacle 262, the head 178 expands to contact the interior surface 266, thereby at least partially filling the receptacle 262, while the stem 186 and the base 182 of each rib 174 are at least partially disposed within and at least partially fill the aperture 258. To that end, the head 178 of the rib 174 may expand so rapidly that an audible sound, e.g., a snap, click, or pop, is generated by contact with the interior surface 266 of the receptacle 262. In this way, the rib 174 snaps within the receptacle 262 and, thus, the outsole 150 snaps into the midsole 230. At the same time, the flanges 270 of the midsole 230 fit on either side of each rib 174 and are received within the gaps 198 of the outsole 150. Accordingly, disassembly or removal of the head 178 form the receptacle is resisted by the narrowed configuration of the aperture 258 to prevent accidental or unintended disassembly.

In some embodiments, the flanges 270 are deformed and/or displaced during assembly due to contact with the ribs 174. In some embodiments, the flanges 270 remain undeformed and in place while the ribs 174 become deformed or displaced due to contact with the flanges 270. The outsole 150 is retained against and/or secured to the midsole 230 at least partially due to the enlarged size of the head 178 and receptacle 262 relative to the stem 186 and aperture 258. In some embodiments, the ribs 174A-D may be fit within the receptacles 262A-D by a sliding translation in a lateral-to-medial or medial-to-lateral direction.

It is contemplated that the head 178 may be displaced, e.g., rotated or bent, about the stem 186 or base 182 of the rib 174 during the assembly process to further enhance retention of the outsole 150 to the midsole 230 after assembly. Additionally or alternatively, the head 178 may become displaced from a pre-assembly configuration (see FIG. 2) to an assembled configuration (see FIG. 4), such that the angle θ is increased or decreased through the assembly process. In addition, with reference to FIG. 4, the height H1 of the ribs 174 is less than the height H2 of the midsole 230. In the illustrated embodiment, the ribs 174 of the outsole 150 are of a height H1 that is approximately 75% of the height H2 of the midsole 230. In some embodiments, the ribs 174 of the outsole 150 are of a height H1 that is greater than 75% of the height H2 of the midsole 230 or, alternatively, the ribs 174 are disposed at varying heights H1 that are greater than or less than 75% of the height H2 of the midsole 230.

As illustrated in FIG. 4, the toe end 162 of the outsole 150 is spaced apart from the toe end 242 of the midsole 230, while the heel end 166 of the outsole 150 is aligned and coextensive with the heel end 246 of the midsole 230. In some embodiments, the toe end 162 of the outsole 150 and the toe end 242 of the midsole 230 are aligned and coextensive. Further, the outsole 150 and the midsole 230 are fit together such that the top surface 154 of the outsole 150 is tightly or firmly pressed against the lower surface 238 of the midsole 230. In some embodiments, voids or discontinuities (not shown) may be formed between the top surface 154 of the outsole 150 and the lower surface 238 of the midsole 230.

It is contemplated that the outsole 150 and/or the midsole 230 can each be constructed as a single, unitary component or, alternatively, each can be constructed of multiple discrete or separable components. It is further contemplated that the outsole 150 and the midsole are manufactured separately from one another. In this way, more complex geometries, e.g., an undercut, can be achieved as compared to a process in which the outsole 150 and the midsole 230 are formed together and/or coupled by traditional means, such as cementing or co-molding. In addition, due to the separate manufacture of the outsole 150 and the midsole 230, lower dimensional tolerances, i.e., accuracy, is required. Further, the outsole 150 can be detached from the midsole 230 without causing damage to the either the outsole 150 or the midsole 230. In this way, the outsole 150 and the midsole 230 can be separated and/or assembled at various stages in the lifecycle of the footwear 100 and by various individuals, e.g., manufacturers and consumers, among others. Additionally, the outsole 150 can be removed and recycled separately from the footwear 100 or the midsole 230. Further, the outsole 150 can be removed by the consumer for replacement with another outsole 150 having different performance properties, such as, e.g., stiffness or cushioning in different locations along the forefoot region 108, midfoot region 110, heel region 112, lateral side 118, and medial side 116.

Figure 5:
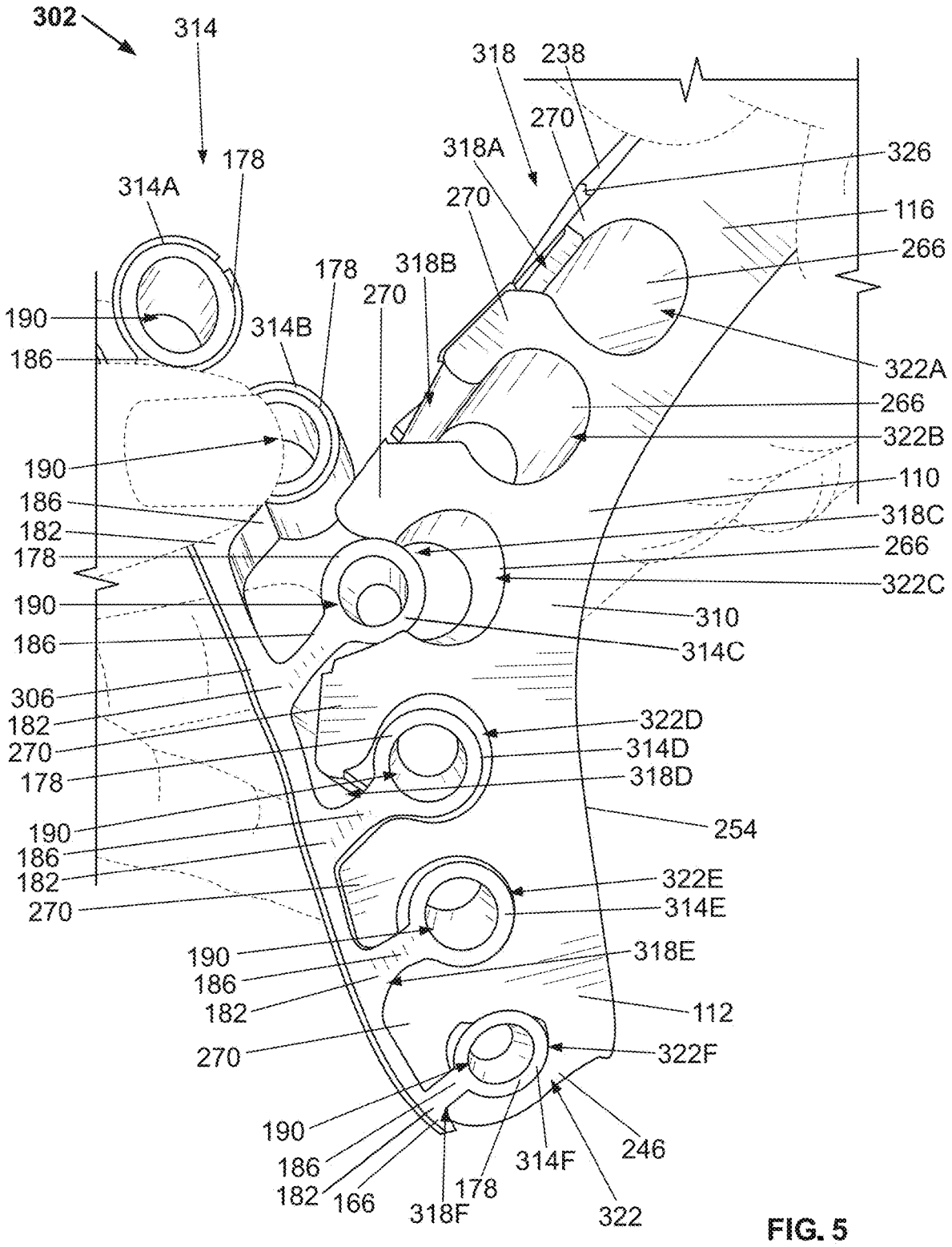
FIG. 5 is a partial medial side view of another embodiment of an interlocking assembly for a sole structure including a midsole and an outsole, the interlocking assembly being depicted in a partially assembled configuration.

With reference to FIG. 5, another embodiment of an interlocking assembly 302 includes an outsole 306 and a midsole 310 that are illustrated in a partially assembled configuration. The midsole 310 and outsole 306 of FIG. 5 are similar to the embodiments of FIG. 4 and, thus, equivalent reference numerals will be used to indicate equivalent elements. As illustrated in FIG. 5, the outsole 306 includes ribs 314, similar to the ribs 174 of FIG. 2. The ribs 314 are a plurality including ribs 314A, 314B, 314C, 314D, 314E, 314F, labeled in sequential order moving in a toe-to-heel direction, i.e., heel-ward. Accordingly, the rib 314A is located farthest from the heel end 166 and the rib 314F is located closest to the heel end 166. Likewise, the midsole 310 includes apertures 318 and receptacles 322, similar to those of the midsole 230 of FIG. 3. With respect to the midsole 310 in FIG. 5, the apertures are a plurality including apertures 318A, 318B, 318C, 318D, 318E, 318F, labeled in sequential order moving in a toe-to-heel direction, i.e., heel-ward. Further, the receptacles 322 are a plurality including receptacles 322A, 322B, 322C, 322D, 322E, 322F, labeled in sequential order moving in a toe-to-heel direction, i.e., heel-ward, and corresponding to the apertures 318A, 318B, 318C, 318D, 318E, 318F. For purposes of clarity, it will be appreciated that the ribs 314A-F, the apertures 318A-F, and the receptacles 322A-F may be referred to herein individually or collectively as rib(s) 314, aperture(s) 318, and receptacle(s) 322, respectively.

Figure 6:
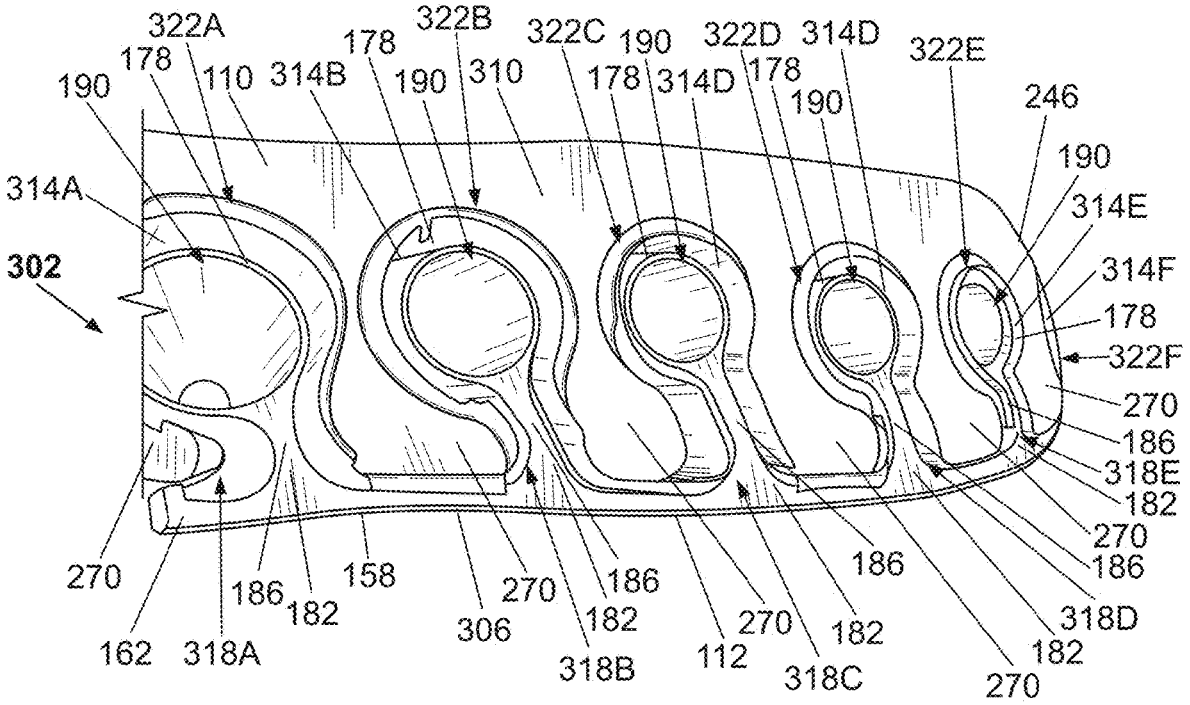
FIG. 6 is a partial lateral side view of the interlocking assembly of FIG. 5, the interlocking assembly being depicted in an assembled configuration.

It will be appreciated from FIGS. 5 and 6 that another method for assembling the outsole 306 to midsole 310 begins by aligning the heel end 166 of the outsole 306 with the heel end 246 of the midsole 310 and positioning the midsole 310 and the outsole 306 in a "V" shape with the heel ends 166, 246 brought together. Then, the rib 314F, which is the most heel-ward, is aligned with the most heel-ward aperture 318F and then pushed or pressed against the flanges 270 of the lower surface 238 of the midsole 310 to pass the head 178 through the aperture 318F and toward the receptacle 322F. In doing so, the midsole 310 may be flexed or bent, as illustrated in FIG. 5, to use a mechanical lever arm and elastic material properties of the midsole 310 for facilitating insertion of the rib 314F within the receptacle 322F. Further, once the rib 314F is received within the receptacle 322F, the remaining ribs 314 are aligned with their corresponding apertures 318 and receptacles 322. Thus, the midsole 310 and the outsole 306 are brought together to cause the remaining ribs 314 to be received within corresponding apertures 318 and receptacles 322. In particular, the adjacent rib 314E is inserted within the receptacle 322E, after which the rib 314D is inserted within the receptacle 322D, and so on consecutively and successively until the rib 314A is inserted within the receptacle 322A, as illustrated in FIG. 6. In this way, the ribs 314A-F are received within and interlocked with the receptacles 322A-F of the midsole 310 in a successive and consecutive interlocking progression moving in a heel-to-toe, i.e., toe-ward, direction. Finally, after the rib 314A is inserted within the receptacle 322A, the toe end 162 (see FIG. 6) of the outsole 150 can be fit within a groove 326 (see FIG. 5) provided on the lower surface 238 of the midsole 310.

FIGS. 5 and 6 illustrate an embodiment of the outsole 306 in which the toe end 162 of the outsole 306 is located within the groove 326 in the midfoot region 110 of the article of footwear 100. Further, as noted above, the outsole 306 generally remains stationary during the assembly process of FIG. 5 while the midsole 310 is flexed, which may be a function of the different materials used to form the outsole 306 and the midsole 310. To that end, the outsole 306 is generally formed of a material having a greater density and, thus, a higher stiffness or rigidity, than a material of the midsole 310. In this way, the midsole 310 can also provide greater cushioning properties for a user while the outsole 306 can provide greater wear-resistance and stability properties. Further, because the outsole 306 can be decoupled from the midsole 310, the outsole 306 can be cleaned, replaced, and recycled separately from the article of footwear 100.

It is contemplated that the outsole 306 and the midsole 310 may be configured to provide varying levels of comfort and performance properties for a user of the article of footwear 100. In some embodiments, the ribs 314 are configured to increase rigidity or stiffness in comparison to the midsole 310. In some embodiments, the ribs 314 are configured to increase spring-like resistance forces in particular areas or locations of the sole structure 104 (see FIG. 1) when compressed during use. In some embodiments, such as in FIGS. 5 and 6, the ribs 314 are configured to improve aesthetic features of the sole structure 104. To that end, the ribs 314 may be exposed through the medial side 116 and the lateral side 118 of the midsole 310, as illustrated in FIG. 5. Alternatively, the ribs 314 may be hidden or concealed from a side view, such as in the sole structure 104 of FIG. 1.

Figure 7:
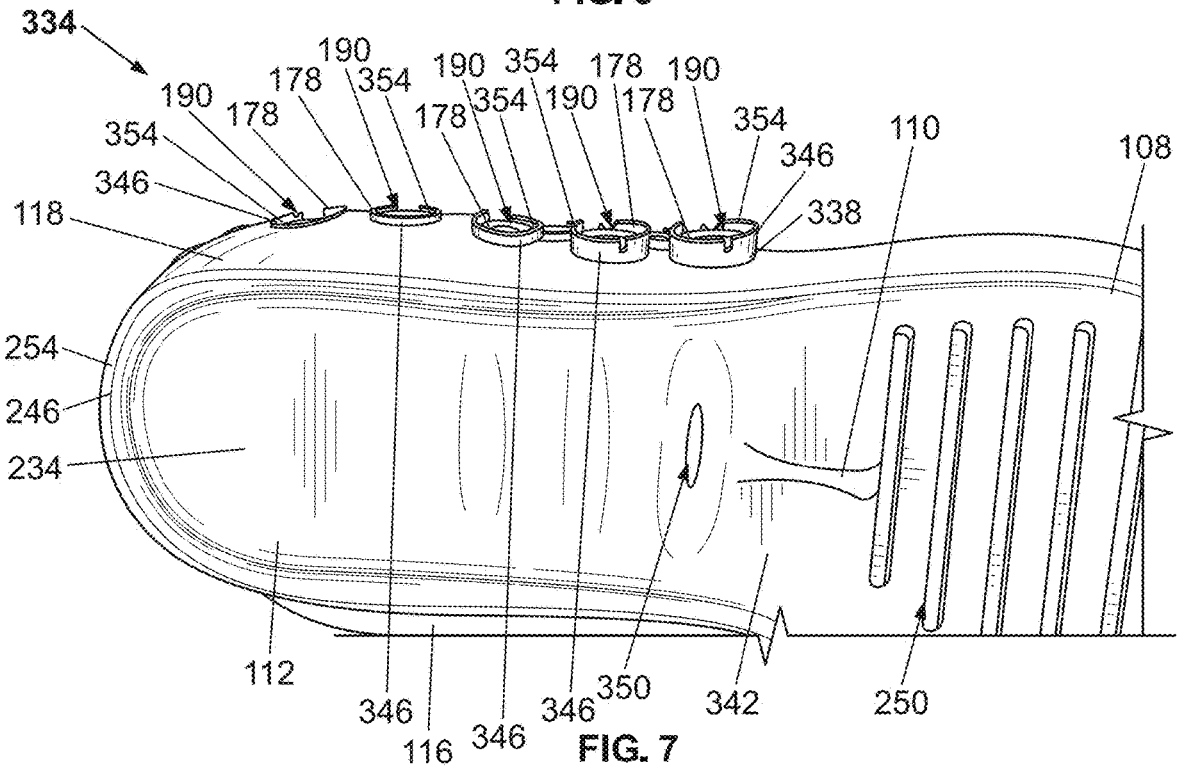
FIG. 7 is a partial top view of another embodiment of an interlocking assembly for a sole structure including a midsole and an outsole, the interlocking assembly being depicted in an assembled configuration.

FIG. 7 illustrates another embodiment of an interlocking assembly 334 including an outsole 338 and a midsole 342 in an assembled configuration. In the illustrated embodiment, the outsole 338 includes ribs 346, similar to the embodiments of FIGS. 2 and 5. In particular, the outsole 338 is illustrated with a plurality of ribs 346. Further, the midsole 342 is illustrated from a top plan view with the plurality of ridges 250 located within the midfoot region 110 and the forefoot region 108 and with the rim 254 extending about the heel region 112 of the upper surface 234. It is contemplated that the plurality of ridges 250 are configured to increase flexibility and reduce an overall weight of the midsole 342. In addition, the head 178 of the rib 346A is partially exposed through a hole 350 within the upper surface 234 of the midsole 342 as a result of a curvature at least partially formed by the rim 254 between the lateral side 118 and the medial side 116 of the midsole 342. To that end, the hole 350 of the midsole 342 is configured to allow movement or transfer of air, which improves moisture control and breathability of the article of footwear 100.

Referring to FIG. 7, the outsole 338 is configured to extend from the lateral side 118 of the midsole 342 and, in particular, the head 178 of each of the ribs 346 of the outsole 338 protrudes or extends from the lateral side 118 of the midsole 342. In this way, the ribs 346 of the outsole 338 may be visible from a side view of the article of footwear 100 to impart particular performance properties and/or to create a visual impression. In some embodiments, the head 178 includes a peripheral flange 354 that extends outwardly as a thin section of material. In some embodiments, the ribs 346 may provide particular lateral or medial stability properties to support changes in direction, to prevent rolling or turning an ankle, or allow for greater traction control, among other desirable properties. Further, the visual impression of the article of footwear 100 may be customized to express creativity or information by way of the ribs 346 of the outsole 338. For example, the head 178 of one or more of the ribs 346 may be shaped as an alphabetical or numerical symbol, such that a user's name, a team name, a phrase, logo, brand, symbol, or even a jersey number may be displayed by the article of footwear 100. In some examples, one or more of the ribs 346 may be provided in a particular shape or color that corresponds to a grade of stiffness, such as, e.g., a red color may indicate a greater stiffness and a blue color may indicate lower stiffness. Further, the ribs 346 may extend outwardly from the midsole 342 at varying distances relative to one another, as depicted in FIG. 7.

Figure 8:
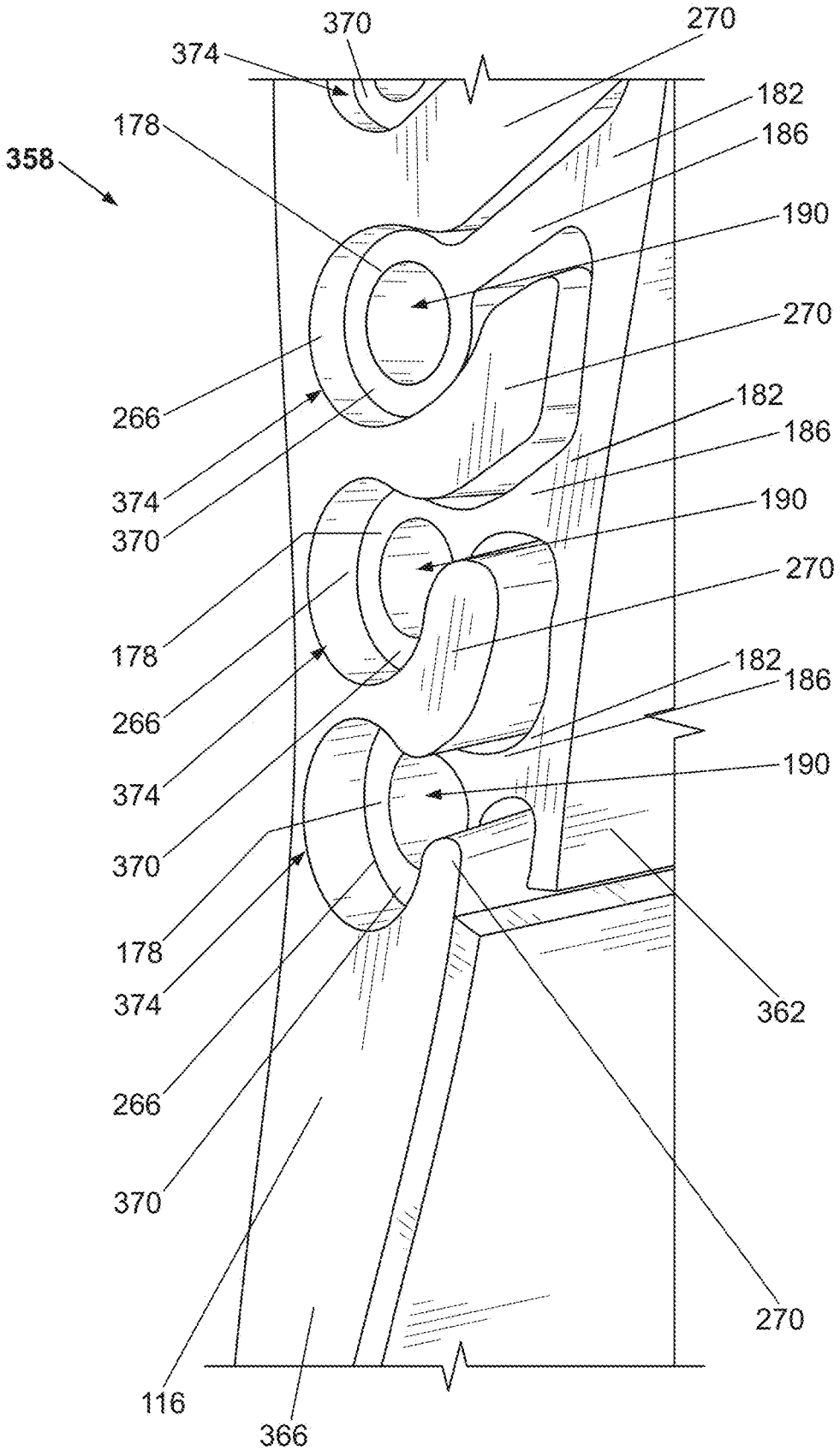
FIG. 8 is a partial medial side view of still another embodiment of an interlocking assembly for a sole structure including a midsole and an outsole, the interlocking assembly being depicted in an assembled configuration.

FIG. 8 illustrates another embodiment of an interlocking assembly 358 including an outsole 362 and a midsole 366 in an assembled configuration. In the illustrated embodiment, the outsole 362 includes a plurality of ribs 370 that are recessed, e.g., offset inwardly, within corresponding receptacles 374 from the medial side 116 of the midsole 366. In particular, the interlocking assembly 358 is illustrated from a bottom perspective view, wherein the interior surface 266 of each receptacle 374 is visible as a result of the recessed position of the ribs 370 within the receptacles 374. Further, the receptacles 374 are open and exposed on the medial side 116 of the midsole 366. Similar to the embodiment of FIG. 7, the ribs 370 are exposed from the medial side 116 of the midsole 366 to impart particular performance properties and/or to create a visual impression, as described above. It is also contemplated the ribs 370 may be exposed from the lateral side 118.

The interlocking assemblies 286, 302, 334, 358 are provided as a lock-and-key configuration in which a particular outsole is configured to fit with a particular midsole by way of particular arrangements or configurations of projections and/or ribs that removably interlock with voids and/or receptacles. To that end, it is contemplated that the interlocking assemblies 286, 302, 334, 358 may be formed with a reversal of parts, e.g., having projections or ribs extending from the midsole and voids or receptacles that are formed on the outsole, or some combination thereof. Additionally, the interlocking assemblies 286, 302, 334, 358 may be retained and/or secured with the use of additional fasteners, such as, e.g., magnetic elements, hook and loop fasteners, buckles, zippers, rail fasteners, or the like.

It is further contemplated that the interlocking assemblies 286, 302, 334, 358 afford additional features as compared to traditional sole structure assembles, such as, e.g., an ability to remove the outsole for continued indoor wear of the footwear indoors. For example, instead of a user removing the entire footwear, one may simply remove the outsole, which may be relatively dirty and/or contaminated by outdoor use, and continue to wear indoors the footwear with the cushioning properties of the relatively cleaner midsole, which is relatively less dirty and/or contaminated as compared to the removable outsole. Such indoor use of the footwear with the outsole removed may present benefits in a variety of applications, such as, e.g., more quickly entering and exiting a residential or commercial building by way of the simplified action of attaching or detaching the outsole.

Additionally, the interlocking assemblies 286, 302, 334, 358 may reduce the need for additional pairs or sets of footwear by expanding the versatility of the footwear to become suitable for a variety of applications. For example, a midsole and upper may be configured for use in several different activities, including running, walking, basketball, tennis, weight-lifting, golf, and soccer, among others, while the outsole is configured for use with only one or less than all of such activities. In some examples, the outsole can carry particular ground-engaging elements, such as cleats, spikes, or the like, that are suited for particular activities, while the midsole and upper are configured to be universal, i.e., suitable for activities beyond those particular outsoles.

Figure 9:
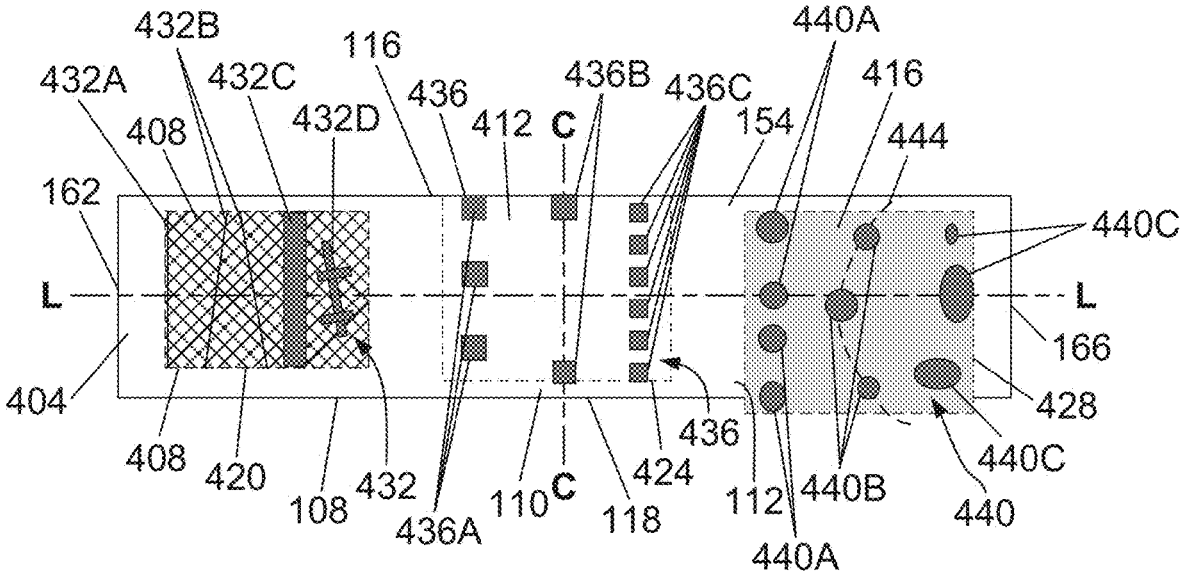
FIG. 9 is a schematic representation of a top plan view of another embodiment of an outsole.

FIG. 9 illustrates a schematic representation of a top plan view of another embodiment of an outsole 404 similar to the outsole 150, such that the outsole 404 includes the top surface 154 that extends from the toe end 162 to the heel end 166. In the illustrated embodiment of FIG. 9, the outsole 404 is depicted with the longitudinal plane L and the central plane C extending therethrough, for illustrative purposes. The outsole 404 includes a first attachment region 408 within the forefoot region 108, a second attachment region 412 within the midfoot region 110, and a third attachment region 416 within the heel region 112. It is contemplated that greater or fewer attachment regions may be located in various locations on the outsole 404. By comparison, the outsole 150 includes the outsole attachment region 194 within the heel region 112, as illustrated in FIG. 2. Turning back to FIG. 9, the first attachment region 408 is illustratively depicted with an imaginary first boundary line 420, the second attachment region 412 is illustratively depicted with an imaginary second boundary line 424, and the third attachment region 416 is illustratively depicted with an imaginary third boundary line 428. A first plurality of ribs 432 are located within the first boundary line 420 of the first attachment region 408. It is contemplated that the first boundary line 420 extends along a periphery defined by the first plurality of ribs 432, such that one or more of the ribs 432 are located on or coincident with the first boundary line 420. In some embodiments, one or more of the ribs 432 are spaced apart from the first boundary line 420 within the first attachment region 408.

In the illustrated embodiment of FIG. 9, the first plurality of ribs 432 are provided of varying sizes and shapes and of different configurations. In particular, the first plurality of ribs 432 includes rib 432A in the form of a thin, linear projection extending continuously in a lateral-to-medial direction, i.e., parallel to the central plane C and spaced centrally on the outsole 404 between the lateral side 118 and the medial side 116. The first boundary line 420 borders the rib 432A at opposing ends thereof, such that the rib 432A is coincident with and adjacent to the first boundary line 420, although other configurations are possible. Further, the first plurality of ribs 432 includes ribs 432B in the form of thin, linear projections extending continuously at angles relative to the central plane C and having opposing ends adjacent to and coincident with the first boundary line 420. Further, the ribs 432B are disposed such that a distance between them increases in a medial-to-lateral direction. Further, the first plurality of ribs 432 includes rib 432C in the form of a rectangular projection extending continuously substantially parallel to the central plane C and having opposing ends that are adjacent to and coincident with the first boundary line 420. The ribs 432C is relatively thicker in a horizontal direction, i.e., parallel with the longitudinal plane L, than the ribs 432A and 432B. Further, the first plurality of ribs 432 includes rib 432D in the form of a generally rectangular projection having cross-members spaced between opposing ends of the rib 432D. The rib 432 is spaced from the first boundary line 420 and disposed at an angle relative to the central plane C. Thus, the first plurality of ribs 432 includes ribs of varying thickness relative to one another, ribs disposed at varying angles relative to one another, and ribs of different shapes and sizes.

In addition, the top surface 154 is depicted as including a texture, i.e., a localized deviation from a perfectly flat plane, within the first attachment region 408 and, thus, within the first boundary line 420. In some embodiments, the top surface 154 may include a variety of texture characteristics, such as, e.g., roughness, waviness, and form, among others. The top surface 154 may be textured by a variety of methods, such as, e.g., grinding, cutting, lapping, blasting, sanding, honing, milling, reaming, laser treatment, additive manufacturing, among others. In any case, the top surface 154 may be textured to increase friction during engagement with an external surface, such as with a midsole. Further, the top surface 154 may include a layer, substrate, or sheet of a different material than the outsole 404 to provide similar frictional or engagement properties.

Still referring to FIG. 9, the second attachment region 412 includes a second plurality of ribs 436 of varying sizes and shapes and of different configurations. In particular, the second plurality of ribs 436 includes a set of ribs 436A in the form of discrete, square-shaped protrusions arranged in a generally linear row, spaced apart from one another between the medial side 116 and the lateral side 118. One or more of the ribs 436A are coincident with and adjacent to the second boundary line 424, and, further, one or more of the ribs 436A are spaced apart from the second boundary line 424 within the second attachment region 412. The set of ribs 436A is arranged asymmetrically about the longitudinal plane L, such that the set of ribs 436A is offset toward the medial side 116, although other configurations are possible. In addition the second plurality of ribs 436 includes a set of ribs 436B in the form of discrete, square-shaped projections that are located within the midfoot region 110 and intersected by the central plane C. As such, the set of ribs 436B are located along the central plane C, coplanar with one another. Further, set of ribs 436B are spaced apart from one another a greater distance than a distance with which the set of ribs 436A are spaced from one another. That is, the set of ribs 436B are arranged such that one of the ribs 436B is located adjacent the medial side 116 and the other of the ribs 436B is located adjacent the lateral side 118. Further, the second plurality of ribs 436 includes ribs 436C in the form an array of six discrete, square-shaped projections disposed linearly between the lateral side 118 and the medial side 116. The ribs 436C are located a spaced a uniform distance apart from one another and the array of ribs 436C is generally symmetrical about the longitudinal plane L. In addition, the ribs 436C are generally smaller square-shape projections than the ribs 436A and 436B. Thus, the second plurality of ribs 436 includes ribs of varying arrangements and spacings from another, ribs arranged in asymmetrical and symmetrical relationships, ribs that are provided as discrete sets or arrays of projections, and ribs of different shapes and sizes and quantities.

With continued reference to FIG. 9, the third attachment region 416 includes a third plurality of ribs 440 of varying sizes and shapes and of different configurations. In particular, the third plurality of ribs 440 includes a set of ribs 440A in the form of discrete, generally elliptical or circular projections of varying sizes and shapes relative to one another. In addition, the set of ribs 440A are arranged to be asymmetrical about the longitudinal plane L and the ribs 440A are spaced varying distances from one another. Moreover, at least one of the ribs 440A is located farther outwardly from the longitudinal plane L than the lateral side 118, although it is contemplated that at least one of the ribs 440A may also be located farther outwardly from the longitudinal plane L than the medial side 116. At least one of the ribs 440A is intersection by the longitudinal plane L, although other configurations are possible. In addition, the third plurality of ribs 440 includes a set of ribs 440B in the form of discrete, generally elliptical or circular projections arranged along a curved path 444 between the lateral side 118 and the medial side 116. The curved path 444 is depicted as being a convex curvature relative to the central plane L, although other configurations are possible. Further, the third plurality of ribs 440 includes the ribs 440C in the form of discrete, generally elliptical or circular projections of substantially different sizes. In particular, a largest of the ribs 440C may be greater than double the size of a smallest of the rib 440C. Thus, the second plurality of ribs 436 includes ribs of varying arrangements and spacings from another, ribs arranged in non-linear or curved paths, ribs that are located outwardly of the lateral and/or medial sides, and ribs of substantially different shapes and sizes and quantities. In the illustrated embodiment, the third attachment region 416 extends outwardly from the lateral side 118. Further, the top surface 154 is depicted as being generally smooth within the third attachment region 416.

Figure 10:
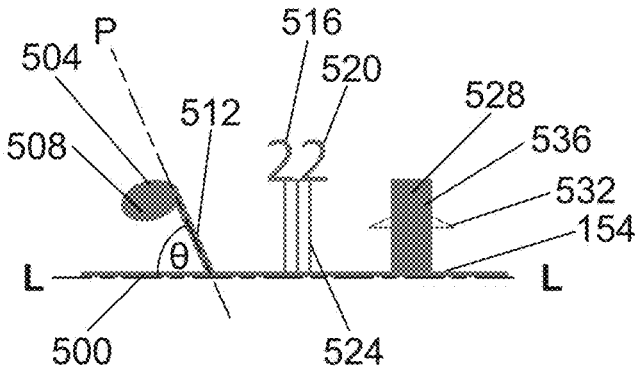
FIG. 10 is a schematic representation of a side view of a portion of another embodiment of still an outsole.

FIG. 10 illustrates a schematic representation of a side view of a portion of another embodiment of an outsole 500. In particular, the outsole 500 includes a modified rib 504 that has a head 508 in the form of a generally elliptical, solid, member that is connected to a stem 512. The stem 512 defines the projection axis P and is disposed at an angle θ, which is less than 90 degrees, although other configurations are possible. An end of the head 508 is connected to the stem 512, such that the head 508 is offset from the projection axis P. In addition, the outsole 500 includes another modified rib 516 having a head 520 connected to a stem 524. In particular, the head 520 is shaped to represent a number, i.e., twenty-two (22). It is contemplated that the head 520 may be shaped to represent a different number, or an alphabetical symbol, or a variety of other symbols or shapes. Further, the stem 524 is depicted as comprising three parallel columnar members spaced apart from one another and disposed substantially orthogonally relative to the longitudinal plane L. In this way, the stem 524 includes gaps or voids thereon. It is contemplated that the stem 524 provides particular cushioning and/or stiffness performance properties that may differ from, for example, the stem 512. For instance, the stem 524 may provide an initial deformation resistance, e.g., upon impact caused by a user bearing weight generally vertically downward, before deforming and/or buckling as a result of the impact, after which the three columnar members of the stem 524 may contact one another to again impart deformation resistance, e.g., a spring-like reaction. Said another way, the stem 524 may be configured to act as a non-linear or linear dampening spring in which resistance varies as a function of time measured after impact. Moreover, the outsole 500 includes yet another modified rib 528 that has a head 532 connected to a stem 536. In particular, the head 532 is positioned between opposing ends of the stem 536, e.g., approximately half of a height of the stem 536, rather than at an end of the stem 536 opposite the top surface 154 of the outsole 500. Further, the head 532 is provided in the form of a protuberance extending generally parallel to the longitudinal plane L and having a cross-sectional shape resembling a right triangle, although other configurations are possible. For example, the head 532 may be disposed radially about a portion of the stem 536. In addition, the head 532 is arranged such that the angled side of the right triangle is positioned farther from the top surface 154 of the outsole 500 than the straight side of the right triangle. In this way, the head 532 is configured for ease of installation within a receptacle of a midsole, as well as for greater retention within the receptacle to resist disassembly or detachment from the midsole.

FIG. 11 illustrates a schematic representation of a perspective view of another embodiment of an outsole 600. In the illustrated embodiment, the outsole 600 includes a top side 604 that is opposite a bottom side or ground-facing surface 608 and a clip 612 extending from the top side 604 at the heel end 124 of the outsole 600. Further, the outsole 600 includes ribs 616 extending from the top side 604 and spaced apart from one another in a heel-to-toe direction, the plurality of ribs 616 comprising a rear set 620 and a front set 624. The rear set 620 of ribs 616 spans from the heel region 112 to the midfoot region 110 of the outsole 600, the front set 624 of ribs 616 spans from the midfoot region 110 to the forefoot region 108 of the outsole 600, and an arch cavity 628 is positioned between the front set 624 and the rear set 620. In addition, the ribs 616 extend continuously from the lateral side 118 to the medial side 116 of the outsole 600. The ribs 616 within the front set 624 are a plurality including ribs 616A, 616B, 616C, 616D, 616E, 616F, 616G, labeled in sequential order moving in a toe-to-heel direction, i.e., heel-ward. Further, the ribs 616 within the rear set 620 are a plurality including ribs 616H, 616I, 616J, 616K, 616L, 616M, labeled in sequential order moving in the heel-ward direction. Accordingly, the rib 616A is located farthest from the heel end 124 and the rib 616M is located closest to the heel end 124. In addition, the rib 616M is coupled to the clip 612 extending from the heel end 124, and a chamber 632 is formed between the rib 616M and the clip 612 in fluid communication with a pair of through holes 636 and 640 formed in the clip 612 on medial and lateral sides, 116, 118, respectively. In the embodiment illustrated, the clip 612 is T-shaped and includes a pair of wings 644 and 648 that each curve from the heel end 124 to the respective medial side 116 and the lateral side 118 of the outsole 600 to connect with the rib 616M.

Still referring to FIG. 11, and with particular reference to the ribs 616A and 616B, each of the ribs 616 include a generally rounded or curved head 652 that is connected to a relatively thinner base 656. For purposes of clarity, the head 652 and the base 656 are only labeled on the ribs 616A, 616B, but it will be understood that every rib 616 includes the head 652 and the base 656. However, the ribs 616 are each uniquely configured to correspond, in part, to a particular location on the outsole 600. For example, the ribs 616A and 616B, which are positioned within the front set 624 and adjacent the toe end 122 of the outsole 600, are provided as substantially solid members that are comparatively thinner than the rest of the ribs 616C-M. By contrast, the ribs 616C-M are each substantially hollow, tubular members. Further, the ribs 616A-M become increasingly thicker in sequential order moving in the heel-ward direction, with the exception of ribs 616L and 616M. To that end, the rib 616A is the thinnest of the ribs 616 and the rib 616K is the thickest of the ribs 616, with each of the ribs 616B-K having a comparatively greater thickness than the rib 616 positioned immediately toe-ward. Because the thickness of the rib 616 corresponds at least partially to the amount of pressure and support experienced, as well as to an amount of return energy and comfort offered by the rib 616, it will be appreciated that the arrangement of thicknesses of the ribs 616 of the outsole 600 is provided for improved performance and comfort when worn by a user during various activities, such as, e.g., training, walking, and running, among others. However, it will be appreciated that ribs 616 having a different arrangement of thicknesses are within the scope of this disclosure.

Referring to FIGS. 11 and 12, the rib 616*g* is hollow and includes a cavity 660 extending from the medial side 116 to the lateral side 118 of the outsole 600. Further, the cavity 660 communicates with a slot 664 that extends through the base 656, such that the base 656 comprises a front leg 668 and a rear leg 672 spaced apart from one another across the slot 664 and connected to the head 652. Accordingly, the front leg 668 and the rear leg 672 of the base 656 at least partially define the slot 664 and the head 652 at least partially defines the cavity 660 of the rib 616G. For purposes of clarity, the cavity 660, the slot 664, the front leg 668, and the rear leg 672 are only labeled with respect to the rib 616G, but it will be appreciated that each of the ribs 616C-M is hollow and includes cavity 660 extending from the lateral side 118 to the medial side 116. Further, it will be appreciated that each cavity 660 of the ribs 616C-L communicates with a slot 664 that extends through the base 656. As illustrated in FIG. 11, the head 652 is generally rounded and, thus, the cavity 660 is also generally rounded like the head 652; likewise, the front and rear legs 668, 672 of the base 656 define the slot 664 with a varying thickness moving in a direction away from the head 652, i.e., toward the top side 604 of the outsole 600, starting to narrow gradually before widening at the top side 604. Further, the slot 664 of each of the ribs 616C-G of the front set 624 is open to and extends entirely through the outsole 600, such that the slot 664 of each of the ribs 616C-G extends through the bottom side 608 of the outsole 600. Still further, the slot 664 of each of the ribs 616H-L of the rear set 620 extends entirely through the outsole 600, including the bottom side 608, on the medial side 116 of the outsole 600 and spanning substantially between the medial side 116 and the lateral side 118 of the outsole 600. However, the slot 664 of each of the ribs 616H-L is interrupted by a traction strip 676 that curves along the bottom side 608 of the outsole 600 from the heel end 124 to the midfoot region 110 along the heel region 112 and on the lateral side 118 of the outsole 600. Accordingly, the traction strip 676 spans across a lateral-heel portion of the slot 664 of each of the ribs 616H-L. Additionally, a plurality of traction pads 680 are arranged on the bottom side 608 of the outsole 600 along the medial side 116 from the heel region 112 to the forefoot region 108, as well as along the lateral side 118 within the forefoot region 108.

Still referring to FIGS. 11 and 12, the ribs 616 are spaced apart from one another to form gaps 684 between the ribs 616 and across the top side 604 of the outsole 600. The gaps 684 are sized and shaped in accordance with the ribs 616, such that the gaps 684 are defined by the size or shape of the ribs 616 and by the spacing, i.e., distance, between each of the ribs 616. The ribs 616 are spaced apart varying distances, such as the relatively larger distance between the rib 616F and the rib 616G. In the embodiment illustrated, a toe flap 688 narrows, i.e., measured in a lateral-to-medial direction, as it extends toe-ward of the frontmost rib 616A. Additionally, the illustrated embodiment includes notches 692 provided in the form of curvilinear, oval-shaped depressions formed between adjacent ribs 616 and along the lateral side 118 and medial side 116 of the outsole 600.

Figure 13:
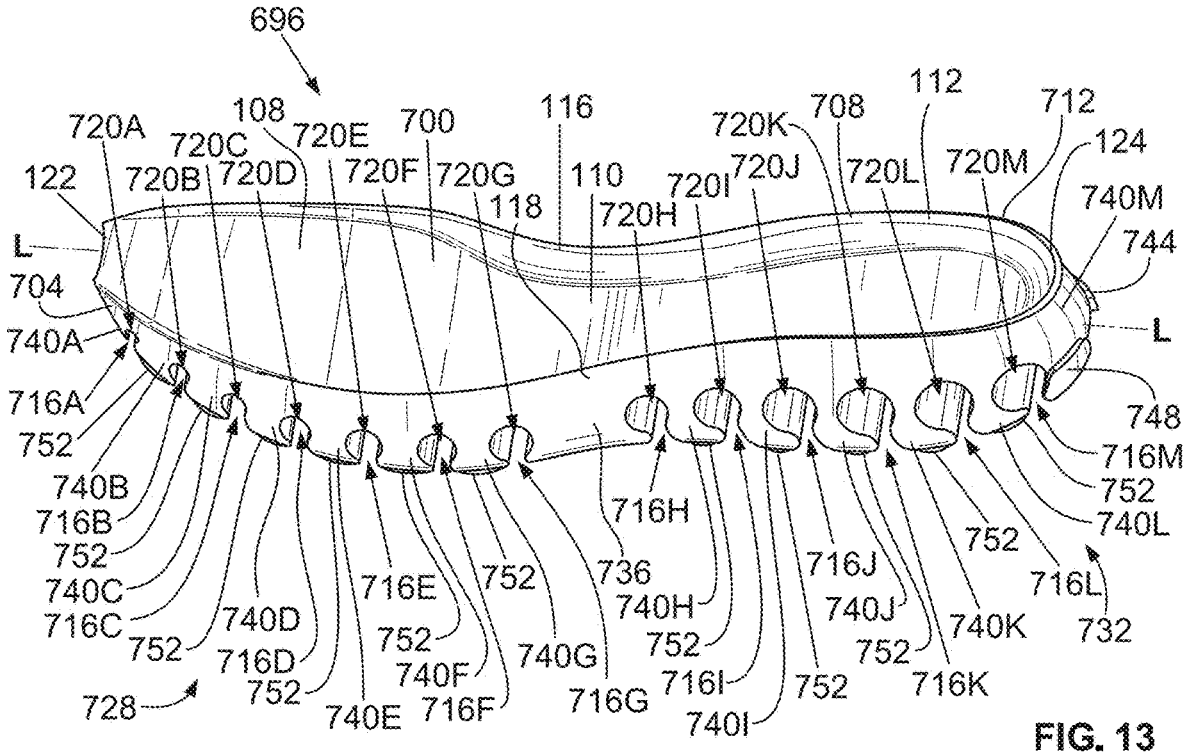
FIG. 13 is a schematic representation of a top perspective view of another embodiment of a midsole.
Figure 14:
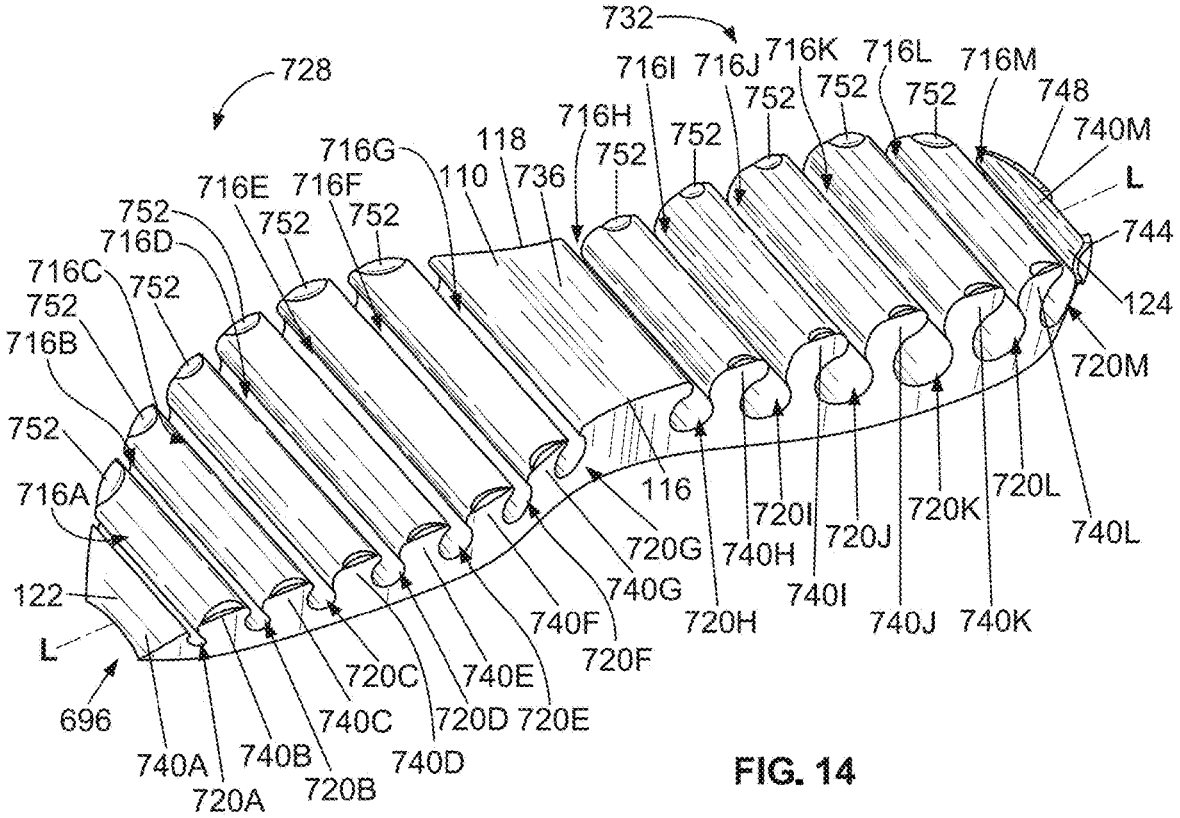
FIG. 14 is a schematic representation of a bottom perspective view of the midsole of FIG. 13.
Figure 15:
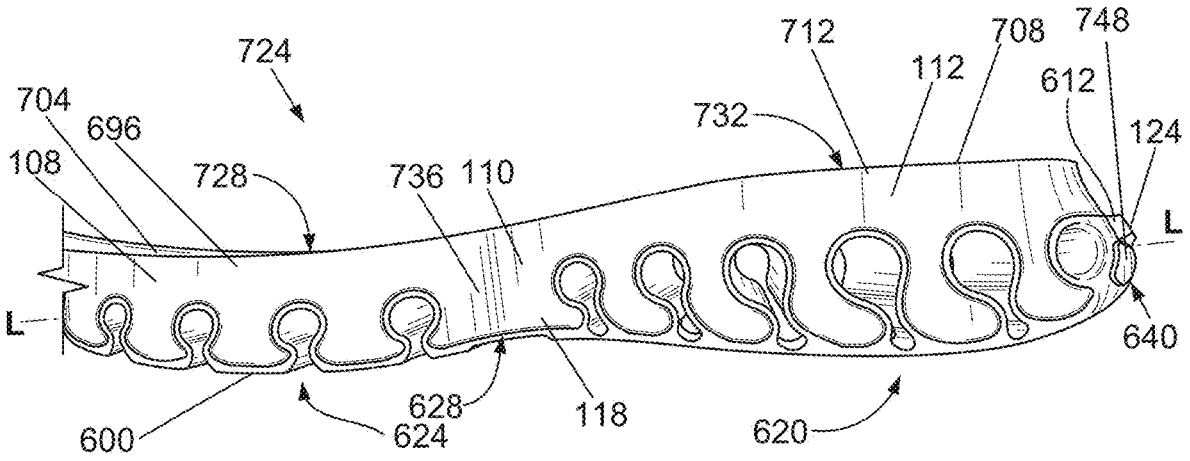
FIG. 15 is a partial representation of a side view of another embodiment of an interlocking assembly in an assembled configuration, the interlocking assembly comprising the outsole of FIGS. 11 and 12 and the midsole of FIGS. 13 and 14.

FIGS. 13 and 14 illustrate perspective, schematic representations of another embodiment of a midsole 696. The midsole 696 includes a top surface 700 that is opposite a bottom surface 704, a rim 708 extending along a periphery 712 of the top surface 700, and a plurality of apertures 716 extending through the bottom surface 704 toward the top surface 700. Additionally, each of the apertures 716 is connected to a receptacle 720 that is configured to receive one of the ribs 616 of the outsole 600 to form an interlocking assembly 724, as illustrated in FIG. 15. Referring back to FIGS. 13 and 14, the apertures 716 of the midsole 696 include apertures 716A-M, which are labeled in sequential order moving in the heel-ward direction, and the receptacles 720A-M, which are also labeled in sequential order moving in the heel-ward direction and corresponding to the apertures 716A-M. Further, the apertures 716A-G and receptacles 720A-G comprise a front group 728 of the midsole 696 that spans within the forefoot region 108. Similarly, the apertures 716H-M and receptacles 720H-M comprise a rear group 732 of the midsole 696 that spans within the heel region 112. An arch support 736 is positioned within the midfoot region 110 of the midsole 696 and separates the front group 728 from the rear group 732. It will also be appreciated that the midsole 696 includes a plurality of flanges 740A-M that at least partially define and bound the apertures 716A-M and receptacles 720A-M. For example, the flanges 740A and 740B bound and define the aperture 716A and receptacle 720A, the flanges 740B and 740C bound and define the aperture 716B and receptacle 720B, and so on. Further, the arch support 736 opposes the flange 740G to bound and define the aperture 716G and receptacle 720G in the front group 728 of the midsole 696, and the arch support 736 also opposes the flange 740H to bound and define the aperture 716H and receptacle 720H of the rear group 732 of the midsole 696. In general, each of the flanges 740 and the arch support 736 are thicker near the bottom surface 704 and curve inwardly to become thinner moving in a direction toward the top surface 700 of the midsole 696.

As illustrated in FIGS. 13 and 14, the receptacles 720 and the apertures 716 are provided of varying sizes and shapes. For example, the receptacle 720A and aperture 716A are relatively thinner, i.e., measured in a heel-to-toe direction that is parallel to the longitudinal axis L, and narrower, i.e., measured in a lateral-to-medial direction, than the adjacent aperture 716B and receptacle 720B. Further, the aperture 716B and receptacle 720B are thinner and narrower than adjacent aperture 716C and receptacle 720C. Accordingly, the flanges 740A-M are also provided of varying sizes and shapes, particularly of varying thicknesses and widths. Further, the arch support 736 is relatively thicker than each of the flanges 740A-M and generally T-shaped, as best viewed in FIG. 14. Referring to FIG. 13, the rearmost flange 740M is provided with a securing feature in the form of first and second blocks 744 and 748 at the heel end 124 of the midsole 696. The first block 744 is located on the medial side 116 of the midsole 696 and the second block 748 is located on the lateral side 118 of the midsole 696. Accordingly, the blocks 744, 748 are spaced apart from one another and separated by the longitudinal axis L. Further, the blocks 744, 748 are disposed closer to the bottom surface 704 of the midsole 696 than to the top surface 700. In the illustrated embodiment, the blocks 744, 748 are generally ellipsoidal-shaped projections that extend outwardly from the heel end 124 of the midsole 696. In particular, the first block 744 extends outwardly from the medial side 116 of the flange 740M and the second block 748 extends outwardly from the lateral side 118 of the flange 740M, although other configurations are possible. Additionally, a plurality of nubs 752 in the form of curvilinear, oval-shaped projections are disposed along the lateral side 118 and the medial side 116 of the flanges 740 and extend from the bottom surface 704 of the midsole 696. In the illustrated embodiment, the nubs 752 are spaced apart from one another and span across the heel region 112, the midfoot region 110, and the forefoot region 108. For purposes of clarity, only the nubs 752 along the lateral side 118 are labeled in FIG. 14.

Figure 16:
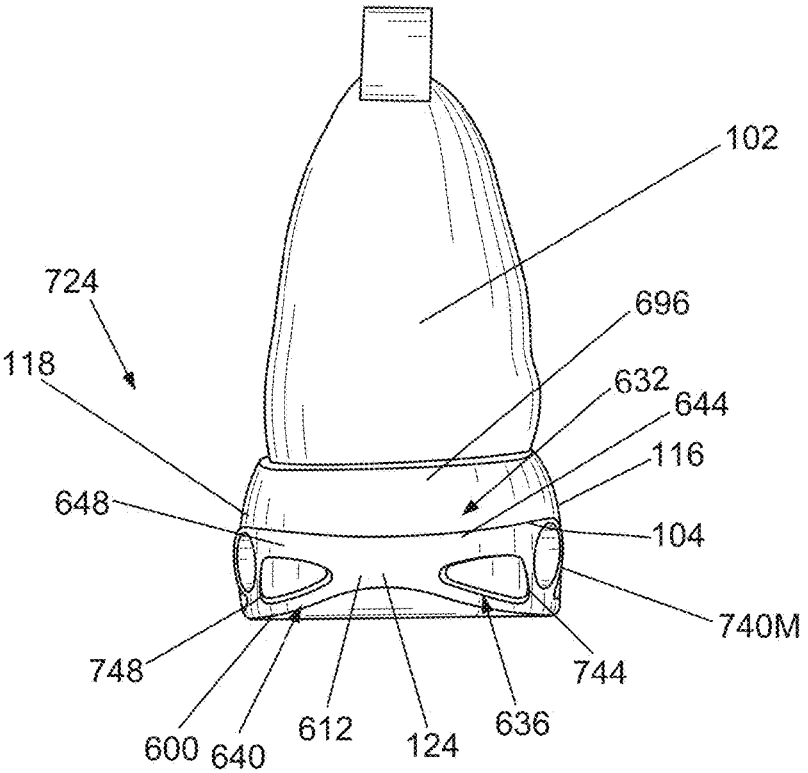
FIG. 16 is a partial representation of a rear view of the interlocking assembly of FIG. 15 being attached to an upper.

Referring to FIGS. 15 and 16, the outsole 600 and the midsole 696 together comprise the interlocking assembly 724 that is configured to be removably attached and detached as part of the sole 104 for an article of footwear. For purposes of clarity, the ribs 616 of the outsole 600 are referenced as the front set 624 and the rear set 620; similarly, the apertures 716, the receptacles 720, and the flanges 740 of the midsole 696 are referenced as the front group 728 and the rear group 732. Accordingly, FIG. 15 illustrates the interlocking assembly 724 in an assembled configuration in which the front set 624 of ribs 616 are configured to be removably coupled with the front group 728 of receptacles 720, the rear set 620 of ribs 616 are configured to be removably coupled with the rear group 732 of receptacles 720, and the arch support 736 is configured to fit within the arch cavity 628. In some embodiments, the outsole 600 and the midsole 696 are flexed to be removably coupled together in a manner similar to the one described in connection with FIG. 5, although other configurations are possible. In some embodiments, only one of the outsole 600 and the midsole 696 is flexed during assembly to form the interlocking assembly 724. It is further contemplated that the interlocking assembly 724 may be assembled by pressing the outsole 600 and the midsole 696 against one another in a substantially vertical direction, i.e., perpendicular to a longitudinal direction defined by the longitudinal axis L, such that no flexing occurs.

Further, as depicted in FIG. 16, the clip 612 of the outsole 600 is configured to fit onto the rearmost flange 740*m* at the heel end 124 of the midsole 696 and the blocks 744, 748 are configured to extend through the respective through holes 636, 640 formed in the clip 612 of the outsole 600. As such, the flange 740M is received within the chamber 632 and the blocks 744, 748 are received in the respective through holes 636, 640 of the clip 612 to assist with locating and/or aligning the outsole 600 and the midsole 696 to form the interlocking assembly 724. Further, the flange 740M fits tightly inside the chamber 632 between the rib 616M and the clip 612, while the blocks 744, 748 fit tightly inside the through holes 636, 640, respectively. As a result, the blocks 744, 748 and clip 612, via the through holes 636, 640, secure the heel end 124 of the interlocking assembly 724 to prevent displacement during use, i.e., activities involving rapid acceleration, high impact forces, continuous and repeated compression and expansion, change in directions or speed, exposure to outdoor environments, any combination thereof, and the like. In addition, when the interlocking assembly 724 is assembled, the notches 692 of the outsole 600 are configured to receive the nubs 752 of the midsole 696 to further assist with alignment and to secure the outsole 600 against displacement relative to the midsole 696.

Referring back to FIGS. 11-15, when the outsole 600 and the midsole 696 are provided in the assembled configuration, the flanges 740 of the midsole 696 are received in the corresponding gaps 684 of the outsole 600, the ribs 616 of the outsole 600 are received through the corresponding apertures 716 and within the corresponding receptacles 720 of the midsole 696, and the arch support 736 is received within the arch cavity 628 of the outsole 600. Further, in the assembled configuration, the interlocking assembly 724 may be coupled using additional and/or alternative fasteners, such as, e.g., hook-and-loop fasteners, magnetic elements, threaded fasteners, twist-lock fasteners, and any other suitable fastener that allows for removable attachment of the outsole 600 to the midsole 696 while preventing displacement in one or more directions, e.g., a toe-ward or heel-ward direction, a lateral and/or medial direction, and upward and/or downward directions. For example, it is contemplated that the toe flap 688 of the outsole 600 and the frontmost flange 740A of the midsole 696 are removably secured together using hook-and-loop fasteners (not shown). In addition, it is contemplated that some or all of the front set 624 of ribs 616 and the front group 728 of receptacles 720 and apertures 716 can be replaced with alternative fasteners, such as hook-and-loop fasteners, among other configurations.

It is further contemplated the upper 102 may be removably attached to the sole 104 utilizing any of the interlocking assemblies 286, 302, 334, 358, 724 disclosed herein. For example, the upper 102 may comprise an insole (not shown) that is provided with a plurality of apertures and receptacles into which a plurality of ribs are configured to be received when assembled together, as a modified version of the interlocking assemblies 286, 302, 334, 358, 724. Alternatively, the insole (not shown) of the upper 102 may be provided with a plurality of ribs that are configured to be received within apertures 716 and receptacles 720 of the sole 104, such as in an inverted configuration of the interlocking assemblies 286, 302, 334, 358, 724. Accordingly, the insole (not shown) may be provided as part of the upper 102 and/or permanently attached to the upper 102, while the upper 102 is removably attached to the sole 104.

Any of the embodiments described herein may be modified to include any of the structures or methodologies disclosed in connection with different embodiments. Further, the present disclosure is not limited to articles of footwear of the type specifically shown. Still further, aspects, such as the interlocking assembly, of the articles of footwear of any of the embodiments disclosed herein may be modified to work with any type of footwear, apparel, or other athletic equipment.

As noted previously, it will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

We claim:

1. An interlocking assembly for an article of footwear, the interlocking assembly comprising:

a first component having a plurality of ribs exposed through a medial side and a lateral side of the first component, each rib of the plurality of ribs having a head that is connected to a base of the first component by a stem, wherein the head is at least partially hollow and includes a cavity extending partially or entirely through the head in a lateral-to-medial direction, wherein the cavity extends into the stem and toward the base, wherein the plurality of ribs extends from a heel region to a midfoot region of the first component; and a second component having a plurality of receptacles, wherein the plurality of ribs of the first component is configured to be received within the plurality of receptacles of the second component such that the cavity of each head at least partially collapses and expands during assembly, whereby the first component and the second component are removably attached.

2. The interlocking assembly of claim 1, wherein at least one of the plurality of receptacles is exposed through a lower surface of the second component.

3. The interlocking assembly of claim 2, wherein the plurality of receptacles is located between the lower surface and a top surface of the second component.

4. The interlocking assembly of claim 2, wherein the plurality of receptacles extends continuously between a medial side and a lateral side of the second component.

5. The interlocking assembly of claim 1, wherein the first component is formed of a different material than the second component.

6. The interlocking assembly of claim 1, wherein the first component is configured to snap into the second component.

7. A sole structure for an article of footwear, the sole structure comprising:

a midsole; and an outsole, wherein the outsole includes a plurality of ribs that are configured to be received within a portion of the midsole, wherein each rib of the plurality of ribs includes a head connected to a base of the outsole by a stem that defines a projection axis that extends through a center of the head along a center of the stem, and wherein the projection axis of the stem extends at an angle that is less than 90 degrees relative to the base, wherein each rib is partially hollow and includes a cavity that extends into the stem and toward the base.

8. The sole structure of claim 7, wherein the plurality of ribs is disposed within a heel region.

9. The sole structure of claim 7, wherein the plurality of ribs is exposed through a lateral side and a medial side of the midsole.

10. The sole structure of claim 7, wherein one or more of the plurality of ribs extends from a lateral side to a medial side of the midsole.

11. The sole structure of claim 7, wherein each rib of the plurality of ribs is configured to removably retain the outsole against the midsole.

12. An interlocking assembly for an article of footwear, the interlocking assembly comprising:

a midsole having a flange that includes a securing feature; and an outsole having a plurality of ribs and a chamber that is at least partially defined by a clip extending from a heel end of the outsole, wherein the flange is configured to be received within the chamber in an assembled configuration, wherein the securing feature is configured to be removably engaged with the clip in the assembled configuration, wherein a through hole is located below and at least partially defined by a portion of the clip that wraps around the flange from a medial side to a lateral side of the footwear, the through hole being configured to receive the securing feature in the assembled configuration, wherein each rib of the plurality of ribs has a head that is connected to a base of the outsole by a stem, and wherein the head is at least partially hollow and includes a cavity extending partially or entirely through the head in a lateral-to-medial direction.

13. The interlocking assembly of claim 12, wherein the securing feature comprises a first block extending from a lateral side of the flange and a second block extending from a medial side of the flange.

14. The interlocking assembly of claim 12, wherein the clip extends from a top surface of the outsole and between a medial side and a lateral side of a heel most rib of the plurality of ribs to at least partially define the chamber.

15. The interlocking assembly of claim 14, wherein a slot extends through the base.

16. The interlocking assembly of claim 12, wherein the outsole and the midsole are configured to be flexed away from one another during disassembly of the interlocking assembly.

* * * * *